US012778251B2

(12) United States Patent
Popwell et al.

(10) Patent No.: US 12,778,251 B2
(45) Date of Patent: Nov. 3, 2026

(54) CONTACT LENS PACKAGES AND METHODS OF OPENING

(71) Applicant: Johnson & Johnson Vision Care, Inc., Jacksonville, FL (US)

(72) Inventors: Sam Jonathan Popwell, Jacksonville, FL (US); Scott F. Ansell, Ponte Vedra Beach, FL (US); Daniel Graham Ward, Bishop's Stortford (GB); Stephen Sams, Bassingbourn (GB); William Stephen Honey, Bath (GB); Ismail Akram, Cambridge (GB)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 0 days.

(21) Appl. No.: 19/271,058

(22) Filed: Jul. 16, 2025

(65) Prior Publication Data

US 2025/0338934 A1 Nov. 6, 2025

Related U.S. Application Data

(62) Division of application No. 18/008,929, filed as application No. PCT/IB2021/061578 on Dec. 10, 2021, now Pat. No. 12,414,615.

(60) Provisional application No. 63/124,835, filed on Dec. 13, 2020.

(51) Int. Cl.
*A45C 11/00* (2006.01)

(52) U.S. Cl.
CPC ..... *A45C 11/005* (2013.01)

(58) Field of Classification Search
CPC ..... A45C 11/005; A45C 11/046; A45C 2011/006; B65D 75/366; B65D 75/36
See application file for complete search history.

(56) References Cited

U.S. PATENT DOCUMENTS

| | | | |
|---|---|---|---|
| 628,053 | A | 7/1899 | Wernicke |
| 3,088,830 | A | 5/1963 | Graham |
| 3,089,500 | A | 5/1963 | Stalcup |
| 3,159,308 | A | 12/1964 | Passavanti |
| D210,248 | S | 2/1968 | Nissel |

(Continued)

FOREIGN PATENT DOCUMENTS

| | | | |
|---|---|---|---|
| BR | 202016013147 | U2 | 4/2019 |
| CN | 1111115 | A | 11/1995 |

(Continued)

OTHER PUBLICATIONS

International Search Report & Written Opinion for PCT Application No. PCT/GB2017/050309 mailed on Jun. 16, 2017, 14 pages.

(Continued)

*Primary Examiner* — Javier A Pagan
(74) *Attorney, Agent, or Firm* — Casimir Jones, S.C.; Thomas J. Lyneis

(57) ABSTRACT

The present invention relates to improved contact lens packages. The package may be configured such that upon opening the package by a wearer the packaging solution drains away from the contact lens and is substantially recaptured in the lid. Lens packages also may include a lens support that facilitates single touch transfer or a colored region that visually indicates to a wearer where to hold the package for opening.

10 Claims, 11 Drawing Sheets

(56) References Cited

U.S. PATENT DOCUMENTS 3,369,656 A 2/1968 Skinner, Jr. et al.
3,414,117 A 12/1968 Leeds
3,473,886 A 10/1969 Leeds
3,490,806 A 1/1970 Lopez-Calleja et al.
3,524,455 A 8/1970 Hoogesteger et al.
3,584,908 A 6/1971 Ray
3,977,517 A 8/1976 Kadlecik et al.
4,187,574 A 2/1980 Wrue
4,392,569 A 7/1983 Shoup
4,415,076 A 11/1983 Campbell
4,444,307 A 4/1984 Jermyn
4,495,313 A 1/1985 Larsen
4,512,601 A 4/1985 Jacobstein
4,659,782 A 4/1987 Spinelli
4,659,783 A 4/1987 Spinelli
4,691,820 A 9/1987 Martinez
D299,085 S 12/1988 Martinez
4,889,664 A 12/1989 Kindt-Larsen et al.
D305,478 S 1/1990 Lahm et al.
4,942,959 A 7/1990 Sauber et al.
4,986,414 A 1/1991 Ashley et al.
5,031,622 A 7/1991 Lahaye
5,039,459 A 8/1991 Kindt-Larsen et al.
5,053,208 A 10/1991 Seamons et al.
5,099,987 A 3/1992 Bieri
5,227,039 A 7/1993 Pankow
5,244,981 A 9/1993 Seidner et al.
5,314,960 A 5/1994 Spinelli et al.
5,331,067 A 7/1994 Seidner et al.
5,371,147 A 12/1994 Spinelli et al.
5,375,698 A 12/1994 Ewart et al.
D356,889 S 4/1995 Ashley et al.
D357,115 S 4/1995 Ashley et al.
D357,352 S 4/1995 Crossman et al.
D357,579 S 4/1995 Ashley et al.
D357,580 S 4/1995 Ashley et al.
5,407,062 A 4/1995 Shannon
D357,803 S 5/1995 Crossman et al.
D358,026 S 5/1995 Crossman et al.
D358,027 S 5/1995 Crossman et al.
D358,028 S 5/1995 Martin et al.
D358,029 S 5/1995 Ashley et al.
D358,481 S 5/1995 Crossman et al.
5,415,275 A 5/1995 Girimont
5,452,027 A 9/1995 Tylec
D362,961 S 10/1995 Crossman et al.
D363,161 S 10/1995 Crossman et al.
5,467,868 A 11/1995 Abrams et al.
5,474,169 A 12/1995 Bauman
5,515,964 A 5/1996 Bauman
D371,678 S 7/1996 Seiferling et al.
5,609,246 A 3/1997 Borghorst et al.
5,620,087 A 4/1997 Martin et al.
5,620,088 A 4/1997 Martin et al.
5,695,049 A 12/1997 Bauman
5,704,468 A 1/1998 Lust et al.
5,711,416 A 1/1998 Bauman
5,722,536 A 3/1998 Pierce et al.
5,732,990 A 3/1998 Yavitz et al.
5,760,100 A 6/1998 Nicolson et al.
5,776,999 A 7/1998 Nicolson et al.
5,789,461 A 8/1998 Nicolson et al.
5,814,134 A 9/1998 Edwards et al.
D401,762 S 12/1998 Abrams et al.
5,849,811 A 12/1998 Nicolson et al.
5,853,085 A 12/1998 Luttrell
5,965,631 A 10/1999 Nicolson et al.
5,998,498 A 12/1999 Vanderlaan et al.
6,010,001 A 1/2000 Osborn, III
6,029,808 A 2/2000 Peck et al.
6,050,398 A 4/2000 Wilde et al.
6,082,533 A 7/2000 Smith et al.
6,087,415 A 7/2000 Vanderlaan et al.
6,138,212 A 10/2000 Chiacchia et al.
6,138,312 A 10/2000 Cummings
6,253,912 B1 7/2001 O'Neill et al.
6,260,695 B1 7/2001 Tasber et al.
6,276,797 B1 8/2001 Shannon
6,286,666 B1 9/2001 Umdasch
6,289,907 B1 9/2001 Horian
6,318,549 B1 11/2001 Bougamont et al.
RE37,558 E 2/2002 Abrams et al.
6,367,929 B1 4/2002 Maiden et al.
D458,023 S 6/2002 Dzwill et al.
6,398,018 B1 6/2002 Livesley et al.
6,401,915 B1 6/2002 Faxe
6,474,465 B1 11/2002 Jux
6,572,165 B2 6/2003 Faxe et al.
D485,064 S 1/2004 Abrams et al.
6,822,016 B2 11/2004 Mccabe et al.
6,867,245 B2 3/2005 Iwata et al.
6,943,203 B2 9/2005 Vanderlaan et al.
D511,893 S 11/2005 Chou et al.
6,976,584 B2 12/2005 Maiola et al.
7,086,526 B2 8/2006 Newman
D543,103 S 5/2007 Roche et al.
7,225,919 B2 6/2007 Hamilton
7,247,692 B2 7/2007 Laredo
7,249,848 B2 7/2007 Laredo et al.
7,398,877 B1 7/2008 Nelson et al.
7,410,050 B2 8/2008 Py et al.
7,426,993 B2 9/2008 Coldrey et al.
7,441,650 B2 10/2008 Tanaka et al.
7,461,740 B2 12/2008 Newman
7,481,529 B1 1/2009 Chen
7,540,376 B2 6/2009 Mahieu et al.
7,553,880 B2 6/2009 Nicolson et al.
7,666,921 B2 2/2010 Mccabe et al.
7,786,185 B2 8/2010 Rathore et al.
7,819,241 B2 10/2010 Post-Smith et al.
7,832,551 B2 11/2010 Newman et al.
7,832,552 B2 11/2010 Newman
7,938,255 B2 5/2011 Newman
7,956,131 B2 6/2011 Arnold et al.
8,022,158 B2 9/2011 Rathore et al.
8,104,608 B2 1/2012 Newman
D658,077 S 4/2012 Newman
8,251,205 B2 8/2012 Azera
8,273,802 B2 9/2012 Laredo et al.
8,399,538 B2 3/2013 Steffen et al.
8,450,387 B2 5/2013 Mccabe et al.
8,470,906 B2 6/2013 Rathore et al.
8,487,058 B2 7/2013 Liu et al.
8,507,577 B2 8/2013 Zanini et al.
D690,207 S 9/2013 Newman
8,528,728 B2 9/2013 Pugh et al.
D695,014 S 12/2013 Mori et al.
8,637,621 B2 1/2014 Iwata et al.
8,703,891 B2 4/2014 Broad
8,833,548 B2 9/2014 Hsieh et al.
8,937,110 B2 1/2015 Alli et al.
8,937,111 B2 1/2015 Alli et al.
8,940,812 B2 1/2015 Reboul et al.
9,044,075 B2 6/2015 Linhardt et al.
9,056,878 B2 6/2015 Fujisawa et al.
9,057,821 B2 6/2015 Broad et al.
9,067,720 B2 6/2015 Howell et al.
9,095,195 B2 8/2015 Mori
9,125,808 B2 9/2015 Alli et al.
9,140,825 B2 9/2015 Alli et al.
9,156,934 B2 10/2015 Alli et al.
9,170,349 B2 10/2015 Mahadevan et al.
9,244,196 B2 1/2016 Scales et al.
9,244,197 B2 1/2016 Alli et al.
9,260,544 B2 2/2016 Rathore et al.
9,297,928 B2 3/2016 Molock et al.
9,297,929 B2 3/2016 Scales et al.
9,320,566 B1 4/2016 Alston, Jr. et al.
9,358,736 B2 6/2016 Wang et al.
D761,020 S 7/2016 Ohara
9,576,609 B2 2/2017 Huang et al.
9,668,558 B2 6/2017 Clamp et al.
9,701,458 B2 7/2017 Barrows et al.
D804,323 S 12/2017 Harrison et al.

(56) References Cited

U.S. PATENT DOCUMENTS

| | | | | |
|---|---|---|---|---|
| D805,920 | S | 12/2017 | Clamp | |
| 9,839,270 | B2 * | 12/2017 | Howell | A45C 13/34 |
| D813,537 | S | 3/2018 | Miura et al. | |
| 10,092,075 | B2 | 10/2018 | Barre et al. | |
| 10,138,042 | B2 | 11/2018 | Fawdington et al. | |
| 10,364,082 | B2 | 7/2019 | Coon et al. | |
| 10,368,621 | B2 | 8/2019 | Barre et al. | |
| 10,463,127 | B2 | 11/2019 | Kim | |
| 10,661,964 | B2 | 5/2020 | Tokarski et al. | |
| D888,411 | S | 6/2020 | Roh | |
| D899,080 | S | 10/2020 | Yasuda et al. | |
| D899,081 | S | 10/2020 | Yamamoto et al. | |
| 10,901,236 | B2 | 1/2021 | Schweizer et al. | |
| 10,926,944 | B2 | 2/2021 | Huang | |
| 11,071,644 | B2 | 7/2021 | Greenwood et al. | |
| 11,077,969 | B2 | 8/2021 | Newman | |
| 11,136,176 | B2 | 10/2021 | Almond et al. | |
| 11,229,266 | B2 | 1/2022 | Almond et al. | |
| 11,628,998 | B2 | 4/2023 | Ho et al. | |
| 11,751,654 | B2 | 9/2023 | Lansing et al. | |
| D1,001,496 | S | 10/2023 | Sawada | |
| 11,992,101 | B2 | 5/2024 | Grischenko et al. | |
| 12,024,350 | B2 | 7/2024 | Rivera et al. | |
| 2001/0004052 | A1 | 6/2001 | Sakanishi | |
| 2001/0017271 | A1 | 8/2001 | Yavitz | |
| 2002/0046958 | A1 | 4/2002 | Lipscomb et al. | |
| 2002/0163212 | A1 | 11/2002 | Py | |
| 2003/0029736 | A1 | 2/2003 | Phillips et al. | |
| 2003/0057111 | A1 | 3/2003 | Ichikawa et al. | |
| 2004/0134005 | A1 | 7/2004 | Pankow et al. | |
| 2004/0238380 | A1 | 12/2004 | Newman | |
| 2005/0087453 | A1 | 4/2005 | Mahieu et al. | |
| 2005/0103649 | A1 | 5/2005 | Vulcu et al. | |
| 2005/0218012 | A1 | 10/2005 | Tanaka et al. | |
| 2006/0201103 | A1 | 9/2006 | Tokarski et al. | |
| 2006/0213783 | A1 | 9/2006 | Tokarski et al. | |
| 2006/0213784 | A1 * | 9/2006 | Tokarski | B65D 81/22 206/5.1 |
| 2006/0237335 | A1 | 10/2006 | Py et al. | |
| 2006/0260956 | A1 | 11/2006 | Stachowski et al. | |
| 2006/0260957 | A1 | 11/2006 | Hamilton | |
| 2006/0272297 | A1 | 12/2006 | Mcfarlane | |
| 2007/0034533 | A1 | 2/2007 | Coldrey et al. | |
| 2007/0164576 | A1 | 7/2007 | Kim | |
| 2008/0047848 | A1 * | 2/2008 | Tokarski | B65D 75/366 206/5.1 |
| 2008/0170201 | A1 | 7/2008 | Filippo | |
| 2009/0045080 | A1 | 2/2009 | Oneill et al. | |
| 2009/0121370 | A1 | 5/2009 | Barrows et al. | |
| 2009/0139879 | A1 | 6/2009 | Tokarski et al. | |
| 2009/0145091 | A1 | 6/2009 | Connolly et al. | |
| 2009/0200182 | A1 | 8/2009 | Post-smith et al. | |
| 2010/0048847 | A1 | 2/2010 | Broad | |
| 2010/0072082 | A1 | 3/2010 | Kang | |
| 2010/0187140 | A1 | 7/2010 | Tokarski et al. | |
| 2011/0017243 | A1 | 1/2011 | Voss et al. | |
| 2011/0094898 | A1 | 4/2011 | Tang et al. | |
| 2012/0000797 | A1 | 1/2012 | Bowers | |
| 2012/0267262 | A1 | 10/2012 | Wang et al. | |
| 2013/0091613 | A1 | 4/2013 | Meltzner | |
| 2013/0277242 | A1 | 10/2013 | Mori | |
| 2014/0027462 | A1 | 1/2014 | Willat et al. | |
| 2014/0043588 | A1 | 2/2014 | Grant et al. | |
| 2014/0183063 | A1 | 7/2014 | Lee | |
| 2014/0246337 | A1 | 9/2014 | Newman | |
| 2015/0000797 | A1 | 1/2015 | Sebald et al. | |
| 2015/0014187 | A1 | 1/2015 | Gilman et al. | |
| 2015/0114851 | A1 | 4/2015 | English et al. | |
| 2015/0150346 | A1 | 6/2015 | Yasuda et al. | |
| 2016/0198825 | A1 | 7/2016 | Fawdington et al. | |
| 2016/0200057 | A1 | 7/2016 | Clements et al. | |
| 2016/0202005 | A1 | 7/2016 | Sjödin et al. | |
| 2017/0165901 | A1 | 6/2017 | Fischer et al. | |
| 2017/0172269 | A1 | 6/2017 | Lin | |
| 2018/0340622 | A1 | 11/2018 | Godfrey | |
| 2019/0046353 | A1 | 2/2019 | Greenwood et al. | |
| 2019/0133275 | A1 * | 5/2019 | Newman | B65D 53/00 |
| 2019/0296396 | A1 | 9/2019 | Sato et al. | |
| 2020/0229560 | A1 * | 7/2020 | Almond | B65D 75/326 |
| 2020/0229561 | A1 | 7/2020 | Almond et al. | |
| 2020/0229562 | A1 | 7/2020 | Almond et al. | |
| 2020/0229563 | A1 | 7/2020 | Almond et al. | |
| 2020/0231351 | A1 | 7/2020 | Almond et al. | |
| 2020/0383440 | A1 | 12/2020 | Newman | |
| 2020/0405636 | A1 | 12/2020 | Chen et al. | |
| 2021/0018661 | A1 | 1/2021 | Swamy et al. | |
| 2021/0080748 | A1 | 3/2021 | Ponte et al. | |
| 2022/0330671 | A1 | 10/2022 | Bruchon et al. | |
| 2023/0033723 | A1 | 2/2023 | Alayon et al. | |
| 2023/0040022 | A1 | 2/2023 | Velez et al. | |
| 2023/0060534 | A1 | 3/2023 | Lansing et al. | |
| 2023/0083028 | A1 | 3/2023 | Popwell et al. | |
| 2023/0113243 | A1 | 4/2023 | Gooch et al. | |
| 2023/0144078 | A1 | 5/2023 | Faulkner | |
| 2023/0159249 | A1 | 5/2023 | Alayon et al. | |
| 2023/0276917 | A1 | 9/2023 | Popwell et al. | |
| 2023/0339672 | A1 | 10/2023 | Popwell et al. | |
| 2023/0354974 | A1 | 11/2023 | Popwell et al. | |
| 2024/0099434 | A1 | 3/2024 | Popwell et al. | |
| 2024/0122321 | A1 | 4/2024 | Popwell et al. | |

FOREIGN PATENT DOCUMENTS

| | | | | |
|---|---|---|---|---|
| CN | 1522131 | A | 8/2004 | |
| CN | 101662967 | A | 3/2010 | |
| CN | 111759065 | A | 10/2020 | |
| DE | 4415003 | C1 * | 6/1995 | A45C 11/005 |
| DE | 202006004323 | U1 | 5/2006 | |
| EP | 0269367 | A2 | 6/1988 | |
| EP | 1708932 | A2 | 10/2006 | |
| FR | 2712398 | A1 | 5/1995 | |
| FR | 2777360 | A1 | 10/1999 | |
| GB | 2551530 | A | 12/2017 | |
| JP | H01279222 | A | 11/1989 | |
| JP | H10313928 | A | 12/1998 | |
| JP | 2001046134 | A | 2/2001 | |
| JP | 5184925 | B2 | 4/2013 | |
| JP | 2014218255 | A | 11/2014 | |
| JP | 2014230613 | A | 12/2014 | |
| JP | 6004912 | B2 | 10/2016 | |
| JP | 2016179837 | A | 10/2016 | |
| JP | 6129238 | B2 | 5/2017 | |
| JP | 6129239 | B2 | 5/2017 | |
| JP | 6339322 | B2 | 6/2018 | |
| KR | 100768522 | B1 | 10/2007 | |
| KR | 20080066930 | A | 7/2008 | |
| KR | 20080090252 | A | 10/2008 | |
| KR | 20090060075 | A | 6/2009 | |
| KR | 20100002433 | A | 1/2010 | |
| KR | 101495874 | B1 | 2/2015 | |
| KR | 20160064382 | A | 6/2016 | |
| KR | 20190003113 | U | 12/2019 | |
| KR | 200490803 | Y1 | 2/2020 | |
| NL | 2000268 | C2 | 4/2008 | |
| RU | 2589278 | C2 | 7/2016 | |
| TW | D159617 | S | 4/2014 | |
| TW | D172590 | S | 12/2015 | |
| WO | 03022321 | A2 | 3/2003 | |
| WO | 2005006062 | A1 | 1/2005 | |
| WO | 200505576 | A1 | 6/2005 | |
| WO | 2005073105 | A2 | 8/2005 | |
| WO | 2006068583 | A1 | 6/2006 | |
| WO | 2006105179 | A1 | 10/2006 | |
| WO | 2008061992 | A2 | 5/2008 | |
| WO | 2008120954 | A1 | 10/2008 | |
| WO | 2009069265 | A1 | 6/2009 | |
| WO | 2012165209 | A1 | 12/2012 | |
| WO | 2012168964 | A1 | 12/2012 | |
| WO | 2013058712 | A1 | 4/2013 | |
| WO | 2013134547 | A1 | 9/2013 | |
| WO | 2013136361 | A1 | 9/2013 | |
| WO | 2013153582 | A1 | 10/2013 | |
| WO | 2014185354 | A1 | 11/2014 | |
| WO | 2014195588 | A1 | 12/2014 | |

(56) References Cited

FOREIGN PATENT DOCUMENTS

| | | | |
|---|---|---|---|
| WO | 2015150704 | A1 | 10/2015 |
| WO | 2017137738 | A1 | 8/2017 |
| WO | 2019013199 | A1 | 1/2019 |
| WO | 2020152446 | A1 | 7/2020 |
| WO | 2021176760 | A1 | 9/2021 |
| WO | 2021260353 | A1 | 12/2021 |
| WO | 2022054031 | A2 | 3/2022 |
| WO | 2022054033 | A2 | 3/2022 |

OTHER PUBLICATIONS

International Preliminary Report on Patentability for PCT Application No. PCT/IB2021/058380 mailed on Mar. 7, 2023, 20 pages.
International Search Report and Written Opinion for PCT Application No. PCT/IB2021/058380 mailed on Oct. 4, 2023, 13 pages.
ASTM D1238-10, "Standard Test Method for Melt Flow Rates of Thermoplastics by Extrusion Plastometer", retrieved from internet: https://store.astm.org/d1238-10.html, Aug. 26, 2013, 3 pages.
Office Action for China Patent Application No. 201780009263.0 mailed on Dec. 30, 2019, 17 pages.
Extended European Search Report for European Application No. 22195203.9, mailed May 22, 2023, 13 Pages.
Partial European Search Report for European Application No. 22195203.9, mailed Jan. 26, 2023, 13 Pages.
International Search Report and Written Opinion for International Application No. PCT/IB2021/061578, mailed May 13, 2022, 32 Pages.
International Search Report and Written Opinion for International Application No. PCT/IB2021/058376, mailed May 3, 2022, 21 Pages.
International Search Report and Written Opinion for International Application No. PCT/IB2021/058380, mailed Mar. 7, 2022, 30 Pages.

* cited by examiner

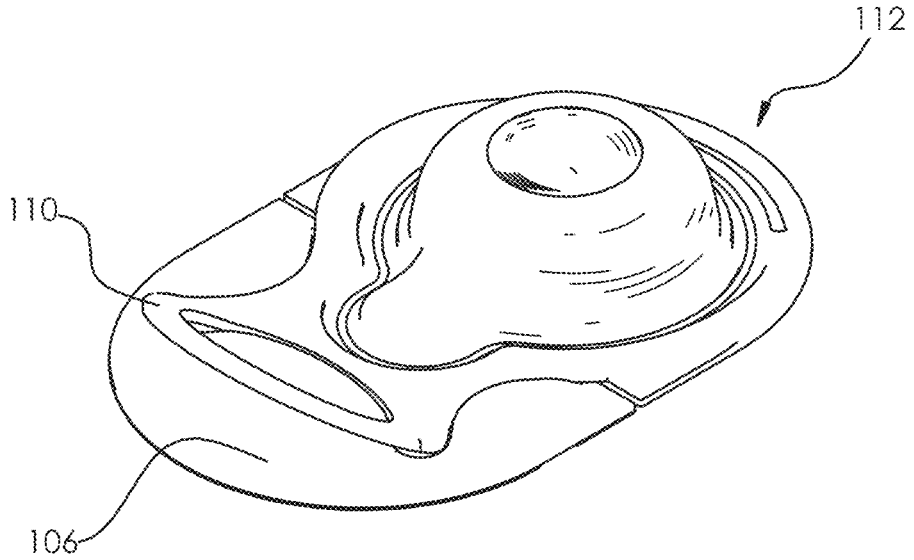
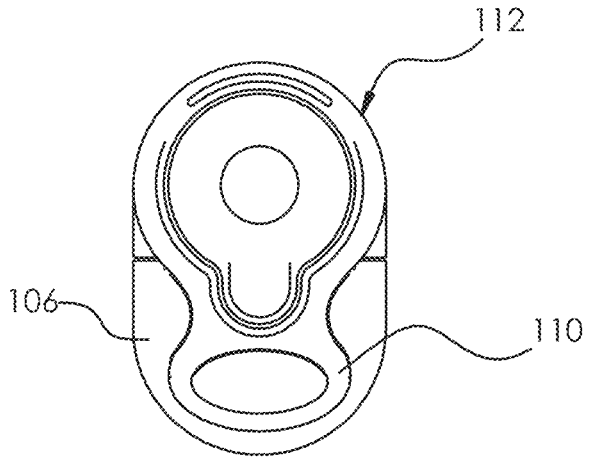
FIG. 1A
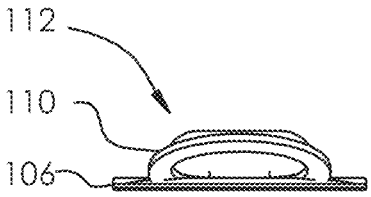
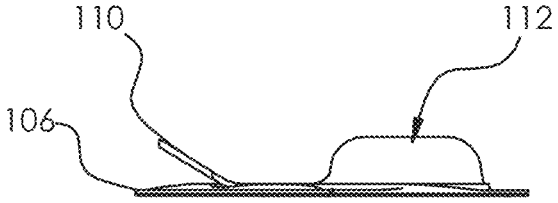

CONTACT LENS PACKAGES AND METHODS OF OPENING

I. CROSS-REFERENCE TO RELATED APPLICATIONS

This application is a divisional of U.S. patent application Ser. No. 18/008,929, filed Dec. 7, 2022, which is a U.S. 371 National Entry Application of international application PCT/IB2021/061578, filed on Dec. 10, 2021, which claims priority to U.S. patent application 63/124,835, filed on Dec. 13, 2020, the complete disclosures of which are hereby incorporated herein by reference for all purposes.

II. BACKGROUND OF THE INVENTION

Over the years, it has been a common perception that it would be ideal to provide wearers of contact lenses with a "single touch" package—that is, a package whereby the wearer of contact lenses can take the lens from the lens storage package with a single touch of one of his or her fingers, and then, with this single touch, position the lens correctly on the eye. In such a design, there would be no need for transfer and manipulation of the lens from one finger to another (as is currently common) before placing the lens on the eye. Providing such a single touch package would not only streamline the lens preparation and insertion process; it would also diminish the possibility of dropping the lens or exposing the lens to additional bacteria on a wearer's other fingers as the lens is being prepared for orientation and insertion onto the eye, and it also reduces the possibility of touching the side of the lens which is intended to contact the eye.

Design of a single touch lens package faces some distinct challenges. The wearer ideally should be able to consistently position the lens to adhere to the finger during removal from the package, and then the lens needs to consistently release from the finger onto the eye. Contact lenses (of both the reusable and daily disposable variety) each have their own unique surface, bulk, and geometric properties. Finger size and the force a contact lens wearer imparts on the lens during transfer can also vary. These factors can impact the process for taking the lens from the package onto the finger and then onto surface of the eye. Among other considerations: it would be desirable for wearers to be able to drain away any packaging solution which might impact the ability of adhering the lens to the finger, as variation in the amount of packaging solution adhering to the lens and package can impact the process of placing the lens on the finger. It would also be desirable for package solution to drain away in a controlled fashion that avoids spillage. It would also be beneficial for the packaging solution to remain sterile and accessible to the wearer after opening to permit re-wetting or cleansing of the lens. Also, the wearer may be concerned about the potential of transferring bacteria or external products such as make up to the contact lens; and of course, manufacture of the package itself should conform to expected industry standards recognized by the medical and commercial provider communities.

Further, the single touch package ideally should not result in an inordinate increase in the cost of goods over current contact lens packages, as this could result in increased costs to the wearer community. The package should not make it difficult to hold the lens when removed from the package. Additionally, if the configuration of the package were to maintain, or even reduce the volume of solution needed to package the lens, this would reduce the ecological impact of the lens package. Similarly, it would be beneficial if all or part of the package could be made of recycled materials, and/or recyclable in whole or part.

In addition, it would be advantageous if the package were composed of materials that are already approved by the various regulatory bodies and ideally did not require a change in solution chemistry or lens composition. Optimally, as well, the functionality of the package preferably does not incorporate any electronics or other electrical components if such components could adversely affect performance of either the package or the lens.

There are several desirable attributes that have made achieving the function of a single touch package challenging and that are often lacking in known attempts to create a single touch package. These attributes include, for example, the following: i) the package ideally should protect lens, i.e., it should ensure the lens's integrity, while at the same time prevent crushing or damage to the lens; ii) the lens package should maintain the hydration of the lens when stored to maintain the lens's properties; and iii) the lens in its package should be configured so that when desired, it is fully submerged in the packaging solution, yet be cleared of such solution when ready to be transferred from the packaging; iv) the package should have a retortable seal and contain both the lens and solution; v) the package preferably should maintain the lens in the desired convex orientation to the wearer; vi) the lens should be correctly positioned so that it can be easily removed by the wearer; and vii) the package should allow the packaging solution to be effectively drained away from the lens upon opening of the packaging and prior to lens removal to enable easier transferred to the wearer's finger and then onto the eye.

WO2014/195588, WO2009/069265, JP6339322, and US20200229563 disclose packages which present the lens in a convex, bowl down configuration. However, the lens support structures substantially match the shape of the contact lens, which provides undesirable contact area between the lens and lens support. These references are also silent as to mechanisms for effective solution drainage from the lens and lens support.

US20190046353 discloses contact lens storage containers that facilitates an increased ease of lens removal. However, the package requires the wearer to pour out the packaging solution and may not provide the desired consistent single touch removal.

US20200229560 discloses packages with lens supports that support the concave (anterior or front) surface of the contact lens, or grates that support the contact lens peripheral edge and allows packaging solution to drain through a grate to a bottom chamber upon opening the lens package where the solution is not readily accessible to the wearer.

The foregoing noted deficiencies of the prior art are merely exemplary and not exhaustive.

Additionally, the introduction of novel contact lens packaging that deviates from the traditional blister package often presents a challenge to wearers. Novel form factors and modalities may not be immediately intuitive. This frequently leads to frustration and/or lenses becoming damaged or desterilized during the opening process. It would therefore be advantageous to provide a contact lens package with visual or tactile cues that make novel contact lens packages and opening experiences more intuitive.

Thus, there remains a need for contact lens packages which provide a consistent single touch lens removal experience, effective solution management, or addresses one or a combination of the aforementioned challenges or deficiencies.

III. SUMMARY

It has now been found that some or all the foregoing and related objects may be attained in a contact lens package having one or more aspects described herein. For example, a contact lens package may have a lid comprising a lid cavity that houses a contact lens and packaging solution, wherein the package is configured such that upon opening the package by a wearer the packaging solution drains away from the contact lens and is substantially recaptured in the lid. In some cases, the packaging solution may be recaptured in the lid cavity. The contact lens package may include a lens support configured to hold the contact lens substantially out of the packaging solution when the package is in an opened state, and the package may also include a grasping member configured to be held by a wearer during opening. In some embodiments, the lid is substantially rigid. In another aspect, the lid cavity may house the contact lens in a convex position package when the package is in an unopened or opened state. The lid may also include an opening tab such as a handle or ring pull. In some embodiments, the package's lens support has a profile that does not substantially match the contact lens's profile. When the package is an opened state, the wetted contact area between the lens support and the contact lens may be less than about 25 $mm^2$, less than about 20 $mm^2$, less than about 18 $mm^2$ or less than about 15 $mm^2$. The lid may further include one or more lens facing surface comprising at least one air entry guide. The base of the package may in some embodiments be configured to hinge upon opening. In another aspect, the grasping member may include a recessed region contoured to matingly receive at least a portion of an opening tab when the package is in an unopened state. Further, in some embodiments package may also include a terminating means for impeding the lid from separating from the base once the package has reached an opened state.

The lens support of the contact lens package may, in some embodiments, include a lens support have a first support member and a second support member configured to support a concave side of a contact lens in a cavity when the package is in an unopened state; wherein the package is configured such that, when the package is in an opened state, the contact lens rests on at least a portion of the first support member and the second support member is moved away from the lens. In one aspect, the second support member pivots away from first support member during opening. The first and second support members are in some embodiments a unitary component.

Further, the second support member may be fixedly attached to at least a portion of a base of the package. First and second support members further may have a nested configuration when the package is in an unopened state. In some embodiments, when the package is in an unopened state, a peripheral edge of the contact lens rests on at least a portion of the second support member. Further still, the first support member may have a first profile that does not substantially match the contact lens's profile. And, in another aspect, the second support member is integral to a base of the package. A drainage path, in some cases, may be defined along a length of the lens support. A hinge may in some case be defined between the lid and a grasping member and transverse to the drainage path, wherein upon opening the package bends along the hinge and the packaging solution drains away from the contact lens along the drainage path.

In certain embodiments, a contact lens package a cavity that houses a contact lens and packaging solution, a lens support for holding the contact lens, and at least one lens facing surface in the cavity above a convex side of the contact lens, wherein when the package is in an unopened state the at least one lens facing surface is configured to i) align the contact lens over the lens support; ii) promote the egress of air to a peripheral volume of the cavity; and iii) protect the contact lens against significant optical damage due to gravitational, mechanical, or air-induced forces. In one aspect, at least one lens facing surface may be further configured to guide air entering the package over the contact lens to reduce the incidence of the contact lens sticking to the package upon opening. In an aspect, lens facing surfaces may comprise a plurality of projections toward a convex side of the contact lens. Contactable surface area between the at least one lens facing surface and the contact lens is at least about 3 percent and preferably more than 20 percent of the lens's convex surface area. Lens facing surfaces may define at least two air egress channels that allow air to travel away from the contact lens into a peripheral volume of the lid cavity. Channels may have a width of between about 1 mm-1.5 mm or 1.5 mm-2 mm. In another aspect, the at least two channels may have a positive gradient toward the peripheral volume and has a minimum vertical rise of at least about 2 mm. In some cases, the at least two channels may be positioned relative to each other such that, when the package is rotated in a side orientation, at least one of the channels has a central axis from near the center of the cavity that is angled relative a plane normal to gravity.

Further still, the contact lens package may include a grasping member and an opening tab, wherein at least one of the grasping member and opening tab comprises a colored region that visually indicates to a wearer a correct orientation of the package or a location to hold when opening the package. In some embodiments, the at least one of the grasping member and opening tab that comprises further includes a substantially clear portion, wherein the colored portion and substantially clear portion are formed by a two-shot injection molding process. The at least one of the grasping member and opening tab may also include a tactile feature and/or one of the grasping member and opening tab comprises printed or embossed product information.

Contact lens packages of certain embodiments may have a substantially flat articulating base; a substantially rigid lid comprising a lid cavity that houses packaging solution and a contact lens in a convex position when the package is in an unopened or opened state; and a lens support configured to support the contact lens substantially out of the packaging solution when the package is in an opened state.

Packages of certain embodiments of the invention may include steps of holding the package at a grasping member of the package; pulling an opening tab of a lid of the package to cause i) the package to bend and break a seal between the lid and a base of the package, ii) packaging solution to drain away from the contact lens and be recaptured in the lid, and iii) the contact lens to be presented to the wearer on a lens support; and transferring the contact lens from the package.

IV. BRIEF DESCRIPTION OF THE DRAWINGS

The foregoing and other features and advantages of the invention will be apparent from the following, more particular description of preferred embodiments of the invention, as illustrated in the accompanying drawings.

FIGS. 1A-E illustrate steps of opening a contact lens package according to an exemplary embodiment of the present invention.

FIGS. 2A-D illustrate cross-sectional views of a contact lens package according to an exemplary embodiment of the present invention at various moments during an opening process.

V. DETAILED DESCRIPTION

Figure 1B:
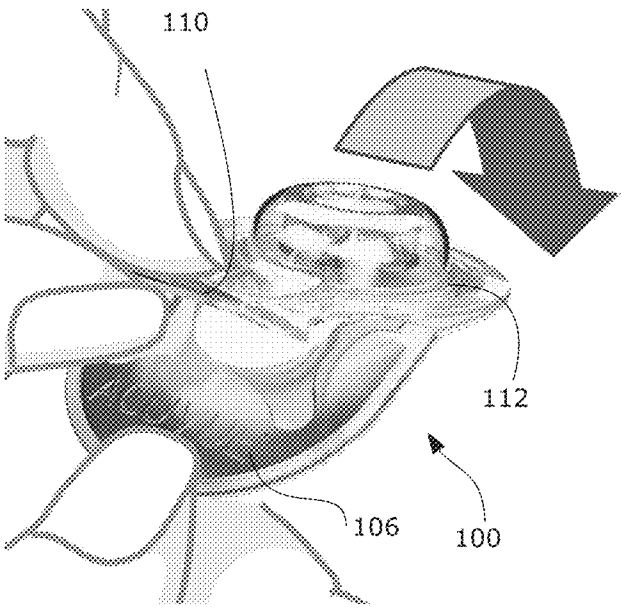
Figure 1C:
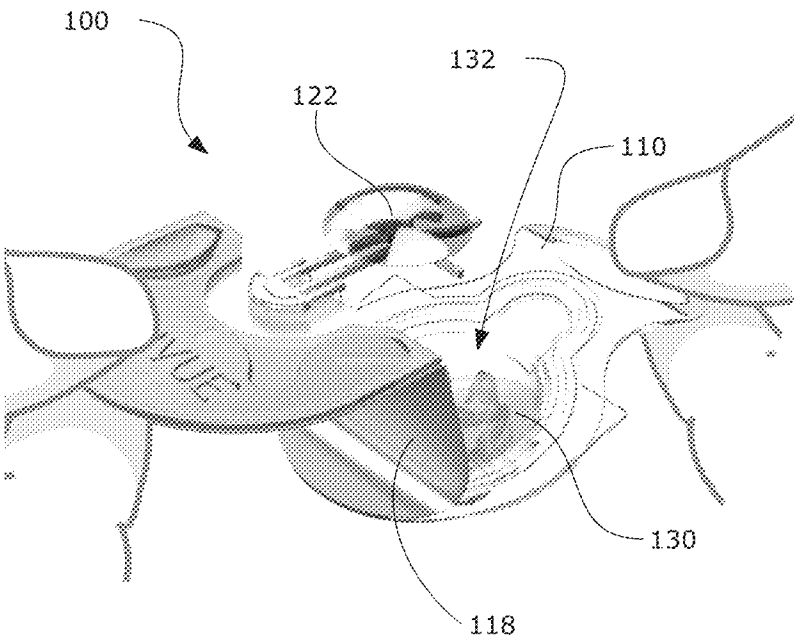
Figure 1E:
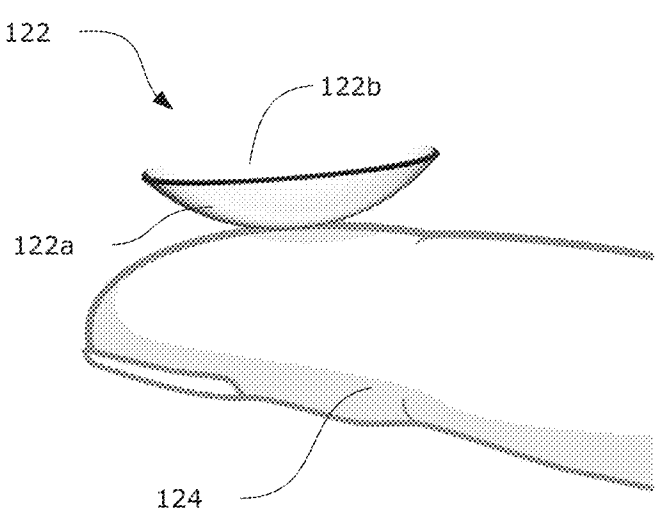
Figure 1D:
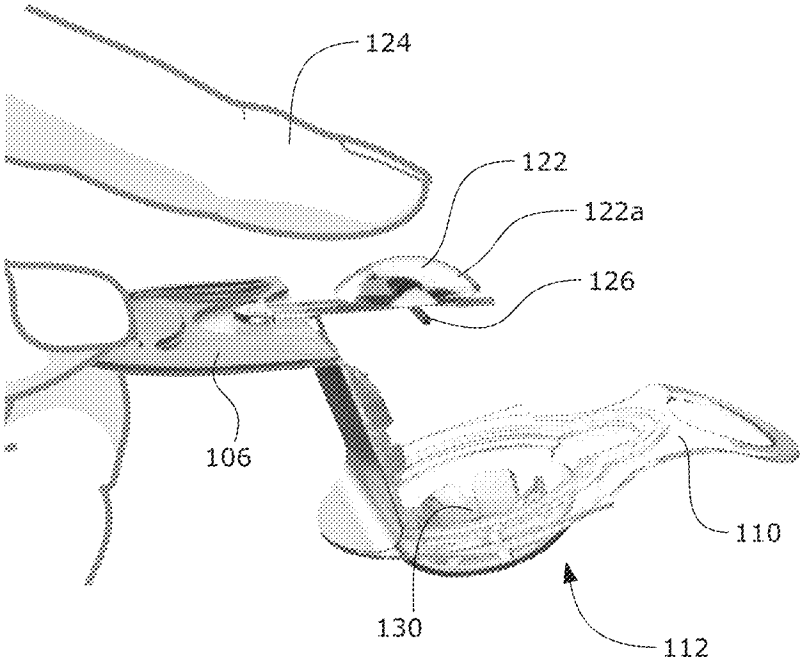

Reference will now be made in detail to representative embodiments illustrated in the accompanying drawings wherein reference numerals indicate certain elements. The following descriptions are not intended to limit the myriad embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, aspect, or characteristic, but every embodiment may not necessarily include the particular feature, structure, or characteristic. Moreover, such phrases are not necessarily referring to the same embodiment. Further, when a particular feature, structure, aspect, or characteristic is described in connection with an embodiment, it is submitted that it is within the knowledge of one skilled in the art to effect such feature, structure, or characteristic in connection with other embodiments whether or not explicitly described.

As used herein, the following terms have the following meaning. A benefit of the certain embodiments the present invention is that they facilitate consistent single-touch lens transfer from the package to a wearer's finger, and then from the finger to the wearer's eye without the lens inverting, falling off the finger or further manipulation. Consistent lens transfer includes a transfer rate of at least about 70%, at least about 80% or at least about 90% transfer on the first touch of the finger (or "dab"). The lens also desirably "sits up" on the finger without collapsing or inverting and then transfers to the eye when placed there. Packages of certain embodiments may provide the desired single-touch transfer across a range of finger sizes, and dab pressures. Environmental conditions such as the temperature and whether the finger is wet or dry may also impact transfer rate, with higher temperatures generally improving lens transfer.

Lens(es) or contact lens(es) refer to ophthalmic devices that reside on the eye. They have a generally hemispheric shape and can provide optical correction, cosmetic enhancement, UV blocking and visible light or glare reduction, therapeutic effect, including wound healing, delivery of drugs or neutraceuticals, diagnostic evaluation or monitoring, or any combination thereof. The term lens includes soft hydrogel contact lenses, which are generally provided to the consumer in a package in the hydrated state, and have a relatively low moduli, which allows them to conform to the cornea. Contact lenses suitable for use with the packages of the present invention include all hydrated contact lenses, including conventional and silicone hydrogel contact lenses.

A hydrogel is a hydrated crosslinked polymeric system that contains water in an equilibrium state, and may contain at least about 25%, or at least 35% water in the hydrated state. Hydrogels typically are oxygen permeable and biocompatible, making them excellent materials for producing contact lenses.

Conventional hydrogel contact lenses do not contain silicone containing components, and generally have higher water content, lower oxygen permeability, moduli, and shape memories than silicone hydrogels. Conventional hydrogels are prepared from monomeric mixtures predominantly containing hydrophilic monomers, such as 2-hydroxyethyl methacrylate ("HEMA"), N-vinyl pyrrolidone ("NVP") or polyvinyl alcohols. U.S. Pat. Nos. 4,495,313, 4,889,664 and 5,039,459 disclose the formation of conventional hydrogels. Conventional hydrogels may be ionic or non-ionic and include polymacon, etafilcon, nelfilcon, ocufilcon lenefilcon and the like. The oxygen permeability of these conventional hydrogel materials is typically below 20-30 barrers.

Silicon hydrogel formulations include balafilcon samfilcon, lotrafilcon A and B, delfilcon, galyfilcon, senofilcon A, B and C, narafilcon, comfilcon, formofilcon, riofilcon, fanfilcon, stenfilcon, somofilcon, kalifilcon and the like. "Silicone hydrogels" refer to polymeric networks made from at least one hydrophilic component and at least one silicone-containing component. Silicone hydrogels may have moduli in the range of 60-200, 60-150 or 80-130 psi, water contents in the range of 20 to 60%. Examples of silicone hydrogels include acquafilcon, asmofilcon, balafilcon, comfilcon, delefilcon, enfilcon, fanfilcon, formofilcon, galyfilcon, lotrafilcon, narafilcon, riofilcon, samfilcon, senofilcon, somofilcon, and stenfilcon, including all of their variants, as well as silicone hydrogels as prepared in U.S. Pat. Nos. 4,659,782, 4,659,783, 5,244,981, 5,314,960, 5,331,067, 5,371,147, 5,998,498, 6,087,415, 5,760,100, 5,776,999, 5,789,461, 5,849,811, 5,965,631, 6,367,929, 6,822,016, 6,867,245, 6,943,203, 7,247,692, 7,249,848, 7,553,880, 7,666,921, 7,786,185, 7,956,131, 8,022,158, 8,273,802, 8,399,538, 8,470,906, 8,450,387, 8,487,058, 8,507,577, 8,637,621, 8,703,891, 8,937,110, 8,937,111, 8,940,812, 9,056,878, 9,057,821, 9,125,808, 9,140,825, 9156,934, 9,170,349, 9,244,196, 9,244,197, 9,260,544, 9,297,928, 9,297,929 as well as WO 03/22321, WO 2008/061992, and US 2010/0048847. These patents are hereby incorporated by reference in their entireties. Silicon hydrogels may have higher shape memory than conventional contact lenses.

Hydrogel lenses are viscoelastic materials. Contact lenses can form optical distortions if the lens interacts with either the package or any air bubble in the package. The extent of the optical distortions, and the length of time needed for the distortions to relax out will vary depending on the chemistry, and to a lesser extent, geometry of the lens. Conventional lens materials, such as polyhydroxyethyl methacrylate-based lenses like etafilcon A or polymacon have low loss modulus and tan delta compared to silicone hydrogels and may form fewer and less severe optical distortions as a result of contact with packaging. The incorporation of silicones (which generally increase the bulk elastic response), wetting agents such as PVP (which generally increase the viscous response) or coatings of conventional hydrogel materials (which may lower the elastic response at the lens interface)

can alter the lens viscoelastic properties. Conventional hydrogel contact lenses and silicone hydrogel contact lenses having short or stiff crosslinking agents and or stiffening agent have short shape memories and may be less susceptible to deformation during storage. As used herein, high or higher shape memory hydrogels display optical distortions from contact with an air bubble or package of at least about 0.18 after 5 weeks of accelerated aging at 55° C. Viscoelastic properties, including loss modulus and tan delta, can be measured using a dynamic mechanical analysis.

The contact lenses can be of any geometry or power, and have a generally hemispherical shape, with a concave posterior side which rests against the eye when in use and a convex anterior side which faces away from the eye and is contacted by the eyelid during blinking.

The center or apex of the lens is the center of the lens optic zone. The optic zone provides optical correction and may have a diameter between about 7 and about 10 mm. The lens periphery or lens edge is the edge where the anterior and posterior sides meet.

The wetted lens is the contact lens and any residual packaging solution attached to it after packaging solution drainage. Wetted contact is the aggregated contact area between the wetted lens and lens support.

Embodiments may include a lens support surrounded by a sealable cavity also interchangeably referred to as a chamber. The cavity may have any convenient form and may comprise a package base and at least a lid, each of which are described in detail below. As used herein, the phrases "the lid", "a lid", "the base" and "a base" encompass both the singular and plural. The lid and package base are sealed to each other to form a cavity which holds the contact lens, support and packaging solution in a sterile state during shipping and storage prior to use. The contact lens package is made from materials which are compatible with the contact lens and solution, as well as retortable and biologically inert.

"Film" or "multilayer film" are films used to seal the package and are often referred to as lidstock. Multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVdC coatings to improve barrier resistance to oxygen or moisture vapor.

An "unopened state" or "unopened" as used herein refers to a contact lens package that is closed and houses a contact lens in solution.

An "opened state" or "opened" as used herein refers to a contact lens package after it has been opened and contact solution has been substantially drained away from the lens and/or the lens has been held or lifted substantially away from the solution.

Packaging solution is any physiologically compatible solution, which is compatible with the selected lens material and packaging. Packaging solutions include buffered solutions having a physiological pH, such as buffered saline solutions. The packaging solution may contain known components, including buffers, pH and tonicity adjusting agents, lubricants, wetting agents, nutraceuticals, pharmaceuticals, in package coating components and the like.

The package base may form the bottom of the package. It can be made from any material suitable for packaging medical devices, including a flat sheet of foil or plastic, a laminate film, or plastic. The bottom of the lens support may be disposed on and or supported by the base surface facing into the package cavity. The lens support may also be integral with the base. The lens support may rest on the inner surface of the package base which may be horizontal or may be angled to maintain the lens support and lens in an angled position when the bottom of the base is horizontal.

The packaging lid generally resides at the upper portion the package and seals with the base to form a cavity containing at least a portion of the lens support, lens, and packaging solution. The lid may be made from any material suitable for packaging medical devices, including a molded sheet of foil or plastic, laminate films, or plastic. Packages comprising plastic for one structure and foil or laminated films as the other, or packages comprising foil or laminated films as the outer layer for the lid and base are known in the art and are examples of suitable combinations.

References throughout this description to injection molding processes and the use of materials conventionally applied to injection molding should be understood as exemplary. Those of skill in the art will appreciate that other means of manufacture are possible within the scope of the appended claims, including but not limited to alternative molding processes, thermoforming, 3D printing, and the like. Likewise, references to heat seals and heat sealing are exemplary to certain embodiment described here and. Other means of securing packaging components will be apparent to those skilled in the art, including the use of adhesive, glue, thermal bonding, welding such as heat, ultrasonic or laser welding, or a mechanical trap, and the like.

Certain aspects of the invention may serve to reduce or prevent significant optical damage to the contact lens due to interactions with air bubbles or the interior of the lens package that may arise during storage or transit due to gravitational or other forces, such as mechanical pressure being applied from outside of the package. As used herein, significant optical damage means a root-mean-squared (RMS) value equal or greater than about 0.08 μm.

With reference to the figures, FIGS. 1A-1E illustrate steps of opening a contact lens package according to an exemplary embodiment of the present invention. An unopened contact lens package 100 having an opening tab 110, lid 112, and grasping member 106 is shown at FIG. 1A. In this embodiment, the opening tab 110 and lid 112 are formed of a unitary plastic part. In a first step shown in FIG. 1B, a wearer holds an unopened contact lens package 100 at the grasping member 106 and pulls the opening tab 110 of the lid 112 of the package 100. Although not required, the wearer may grasp the package 100 with one hand and pull the opening tab 110 with the other hand. As illustrated at step shown in FIG. 1C, pulling the opening tab 110 causes the package 100 to bend and break a seal between the lid 112 and a base 118 of the package 100. In this embodiment, the package 100 bends by hinging along the base 118, which in this case is a multilayer film or laminated foil seal that is heat sealed to an upper portion of the package comprised of a grasping member 106, lid 112, and lens support 126, of the package 100.

As package 100 opens, packaging solution 130 drains away from contact lens 122 and is recaptured in the lid 112 and, in this case, specifically lid cavity 132, i.e., a cavity formed in the lid 112 that houses the contact lens 122 and packaging solution 130 when the package is in an unopened state. As the package opens further, the contact lens 122 is presented to the wearer on a lens support 126, which holds the contact lens 122 substantially out of the packaging solution 130. Holding a lens in this context means allowing the lens to rest support against the support. This allows, as shown in the step illustrated by FIG. 1D, the wearer to transfer the lens 122 from the package 100. In this embodiment, the lens conveniently is presented to the wearer in a convex orientation, meaning that the convex side 122*a* of the lens is accessible to the wearer without the need to reorient the lens before placing the concave side of the lens onto the wearer's eye surface. It will be appreciated however that other orientations, such as the concave orientation of traditional blister packages, are possible within the scope of invention. Transfer of the contact lens from the lens support 126 may be performed by a wearer's finger 124, either directly touching the lens or indirectly by way of an applicator film (e.g., as described in US20190046353) or other covering applied to the finger, or may be performed by another transfer means, such as a manual or automatic applicator device. Upon transfer of the contact lens 112 from the package 100, the lens rests on the finger 124 (or other transfer means), as shown in step illustrated in FIG. 1E, with the contact lens's convex side 122*a* against the finger 124 and the concave side 122*b* of the lens oriented for direct application to the wearer's eye surface.

Turning now to FIGS. 2A-2D, shown are cross-sectional views of a contact lens package according to an exemplary embodiment of the present invention at various moments during an opening process. Beginning at FIG. 2A, a contact lens package 200 is illustrated in a cross-sectional view in a sealed, unopened state. A contact lens 222 and packaging solution 230 are sealed within a cavity 232 between a base 206 and lid 212 of the package 200. The package 200 flanks the lens 222 with a lens support 226 below the lens 222 and by lens facing surfaces 234 from above the lens 222. As discussed in more detail below, lens facing surfaces of the present invention may serve to align the contact lens over the lens support, minimize interactions with air bubbles in the packaging solution, and/or prevent significant optical damage to the contact lens. In some embodiments, lens facing surfaces also serve as air entry guides by guiding air entering the package over the contact lens to reduce the incidence of the contact lens sticking to the package upon opening. In the illustrated embodiment, the lens facing surfaces 234 are formed by projections 234*a* and 234*b* extending downward toward a convex surface of the lens 222. However other configurations are possible, for example, where a continuous interior surface is thick enough or positioned closely enough to the contact lens to provide one or more of the functions of the lens facing surfaces described herein.

Figure 2A:
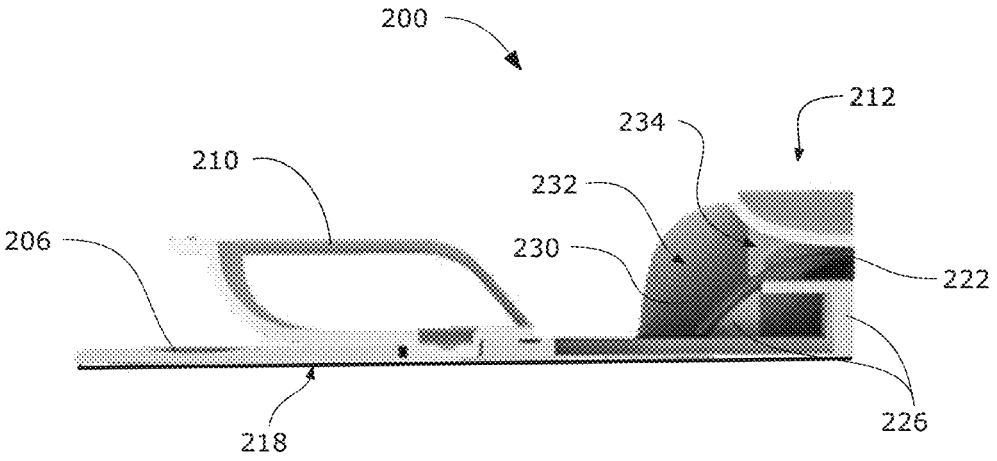
Figure 2B:
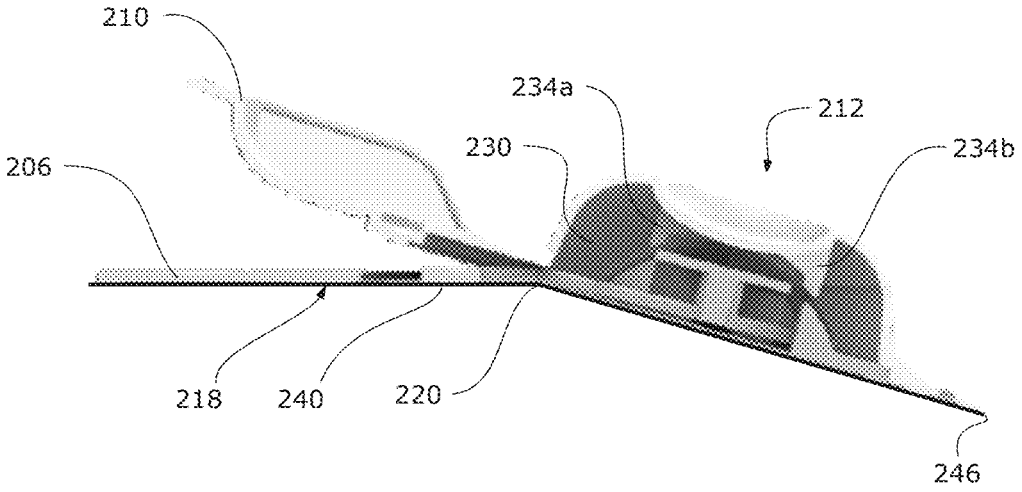
Figure 2C:
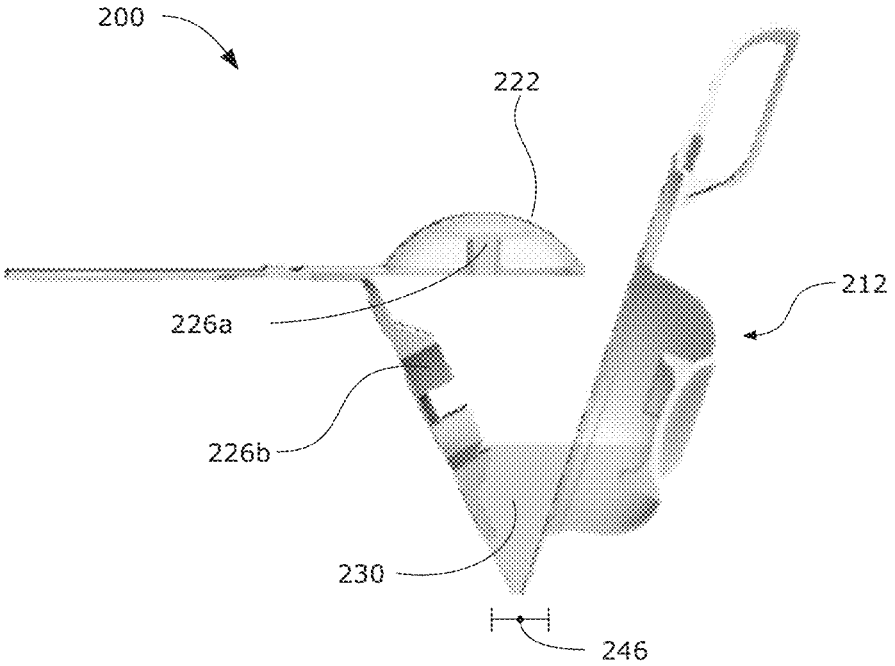

Opening of the package 200 is initiated, as shown in FIG. 2B, by pulling an opening tab 210, which in this embodiment takes the form of a handle/lever. As the opening tab 210 is lifted, the seal between the lid 212 and the base 218 begins to break at a point 220 where the lid 212 is sealed to the foil seal that composes at least part of the base 218. Air then enters the package 200 and the packaging solution 230 begins to move. As it moves, the packaging solution 230 is contained by the angle at which the base 218 and the lid take in relation to the grasping member 206. The surface tension of the packaging solution aids its ability to remain in the space between the base 218 and the lid 222. Here, the grasping member 206 and lid 212 meet at a hinge 240 defined by a gap between the grasping member 206 and the lid 212, which are discrete components each sealed to the base 218. As shown in FIG. 2C, the package 200 opens further and the base 218 to the right of the hinge 240 move away from the lens, causing the solution to drain away from the lens 222 and lens support 226 holds the lens in a convex orientation upon opening. The seal between the lid and the base 218 continue to break toward a distal end 246 of the package 200 as the base 218 and the lid 212 cooperate to contain the packaging solution 230 and funnel it back into the 212 lid under the force of gravity. It should be appreciated that the lid and grasping member may, in other embodiments, be formed by a single, unitary component such as a single injection-molded part. In such embodiments, a gap may not be present, and a hinge or other articulation may be effected by a thin or thinned boundary between the lid and the grasping member. Likewise, while a foil seal is utilized as a base material in the embodiment depicted, other substantially flexible materials or substantially rigid materials configured to articulate, fold, or pivot/hinge in a predictable manner may accommodate the same or similar functionality.

Figure 2D:
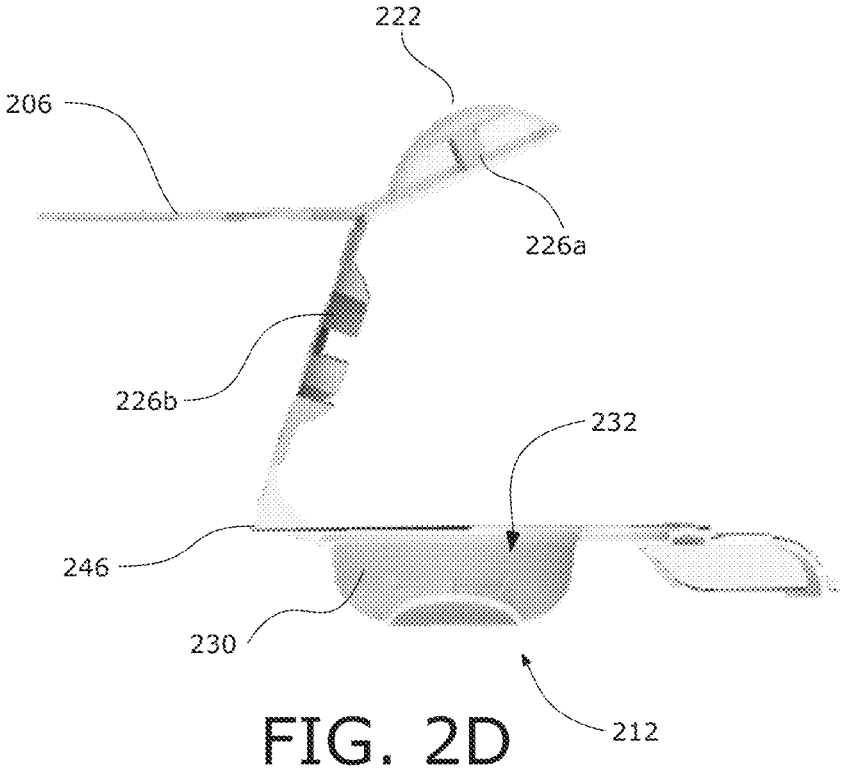

When the package 200 reaches an opened state, as shown in FIG. 2D, packaging solution 230 has been substantially recaptured in the lid 212 and more specifically into the lid cavity 232. Advantageously, the packaging solution 230 has drained away from the contact lens 222 as an integral part of the opening motion, while maintaining packaging solution sterility, which is beneficial in the event the wearer wishes to cleanse and/or rehydrate the lens. The lens 222 is also presented to the wearer in a convex orientation, which facilitates single-touch transfer. Although recapture into the lid cavity is preferred, it will be appreciated that alternative embodiments of recapture within the lid are possible within the scope of the appended claims. For example, one or more features, such as reservoirs or dams may be incorporated into the lid to accomplish the same or similar functionality. In its opened state, it is preferable that the upper portion of the package does not completely separate from the base. Maintaining a connection between the upper portion and the base aids in preventing the recaptured packaging solution from spilling out of the package. By maintaining connection, the lid also weighs down the base and keeps it out the way for the wearer to transfer the lens, such as by dabbing with his or her finger. Maintaining the connection between the upper portion of the package and the base after opening may be accomplished in some embodiments by maintaining the opened lid in a substantially horizonal position after opening, e.g., at the moment when the wearer may release one hand from the package to transfer the lens from the package to the eye. This aspect may be accomplished by providing the package with a terminating means for impeding the lid from separating from the base once the package has reached an opened state. Suitable terminating means include a region of material integral to one or both of the lid and the base, a plastic frame, an additional seal at the distal end of the package separate from the restorable seal formed between the lid cavity and the base or a reinforcement such as a plastic insert, a plastic layer, a double layer foil, or the like. When the terminating means is an additional seal between the distal portion of the lid and the base comprises a flexible sheet material, the seal may be created by any suitable means, including adhesive, glue, thermal bonding, welding such as heat, ultrasonic or laser welding, or a mechanical trap, and the like.

In one aspect, a lens support may advantageously include two or more support members. For example, as embodied in lens support 226, the lens support 226 includes a primary support member 226*a* and a secondary support member

226*b*, each of which support the contact lens 222 in the cavity 232 when the package is in an unopened state. As illustrated in FIG. 2C, upon opening, the contact lens 222 rests on the first support member 226*a* and the second support member 226*b* is moved away from the lens. More specifically, the secondary support member hinges away with the base 218 and the packaging solution 230 drains into the lid 212. In this example, the primary support member primarily functions to hold the lens out of solution and facilitate effective lens transfer whereas the secondary support member protects and supports the lens and particularly the peripheral portion of the concave surface of the lens when the package is unopened. Although optional, splitting the support member into two functional support members, also referred to herein as a split support arrangement, may provide several benefits discussed in more detail with reference to FIGS. 5A and 5B.

Figure 3:
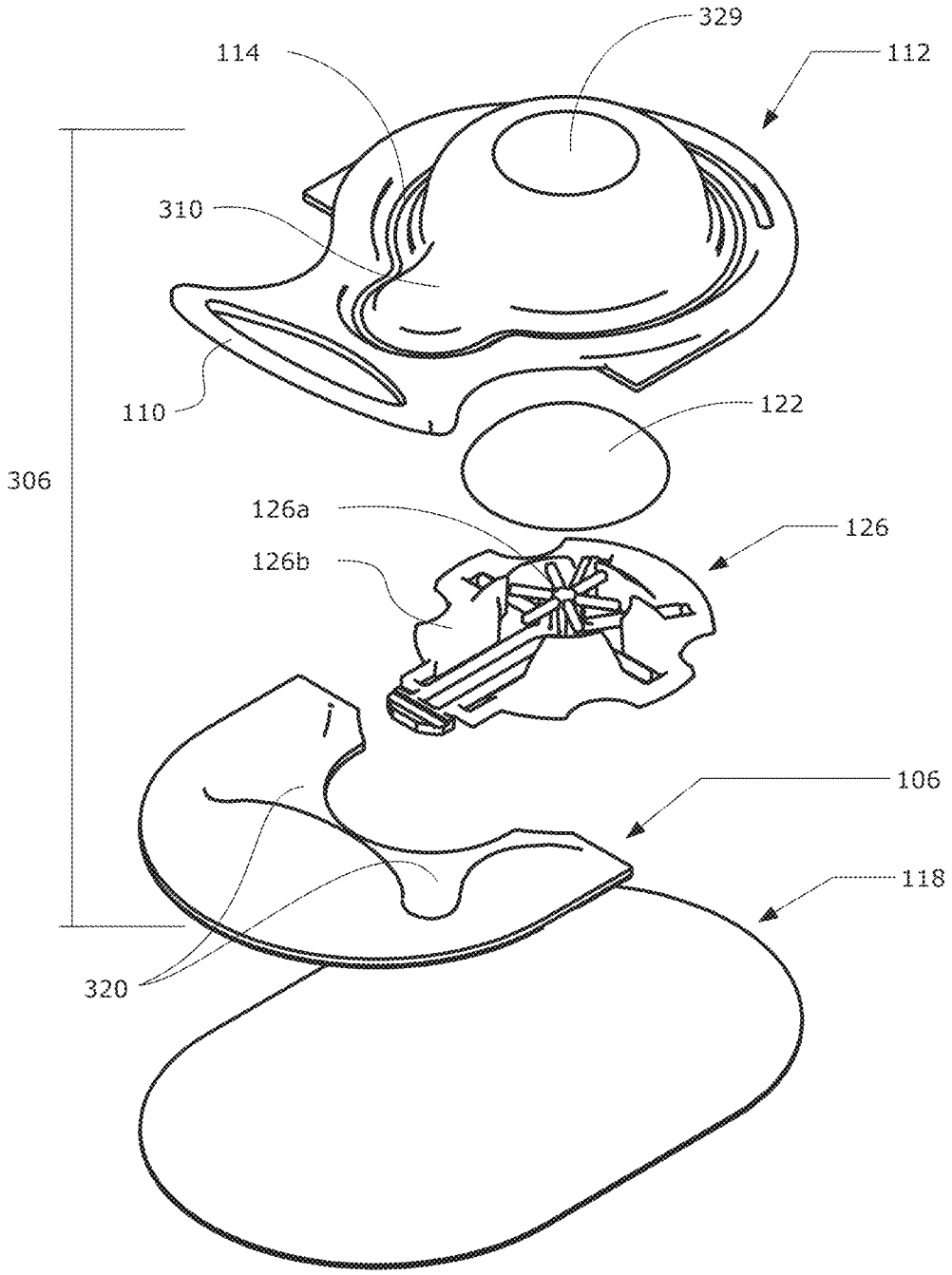
FIG. 3 illustrates an exploded isometric view of a contact lens package according to an embodiment.

FIG. 3 illustrates an exploded isometric view of a contact lens package 100 and the exemplary embodiments' constituent components: lid 112, lens support 126, grasping member 106, and base 118. In the embodiment shown in FIG. 3, the base 118 is composed of a laminated foil sheet. An upper portion 306 of the package 100 includes lens support 126, the lid 112, and the grasping member 106, which are formed of molded plastic and attached to the base 118 via heat seals. The lid 112 is releasably attached to the package base via a retortable seal 114 around a lid cavity that houses the contact lens 122, lens support 126, and packaging solution. The lid 112 includes opening tab 110 in the form of a raised ring pull that is angled at about 150° relative to the base 118. Lid 112 further includes an air entry scoop 310 located along a point in the seal 114 that first breaks when the opening tab 110 is engaged by the wearer. The scoop 310 is aligned with the opening tab 110. The air entry scoop 310 slopes via a chamfer into the lid cavity 132. In other embodiments, air entry scoops may have any shape including but not limited to round, ovoid, triangular, square rectangular or irregular. Packages of the present invention may also forego a separate air entry scoop such as by providing at least about 2 mm clearance between the interior lid wall and lens support at the opening tab 110. In the embodiment shown in FIG. 3, the lid 112 also includes a depression or dimple 329 positioned in the lid 112 above the center of the lens support 126 to provide a volume for trapped air to move into a peripheral volume inside the lid cavity 132 and away from the lens 122. The depth of the dimple is selected so that the nadir of the dimple in the lid interior, or any lens facing surface in the interior of the lid do not touch the apex of the lens when the package is sealed.

Grasping member 106 includes a region 320 contoured to matingly receive the portion of opening tab 110 that overlaps the grasping member 106 when the package is sealed/unopened. This arrangement effectively seats the opening tab 110 in the grasping member 106, which lends additional lateral stability and may facilitate better sealing between the upper portion 306 and the base 118. Compared with a relatively flat and/or thin alternative, the grasping member 106, which is thickened to accommodate the contoured area 320, provides additional structural rigidity to the grasping member 106, which may advantageously create more leverage and a more defined hinge or inflection point when the package is opened. Lens support 126 has a split arrangement with a primary support member 126*a* centrally located beneath the lens when the package is unopened and the secondary support member 126*b* surrounding the primary support member beneath a peripheral edge of contact lens 122 to provide support to the peripheral concave side of the lens 122 when the package is unopened.

Figure 4:
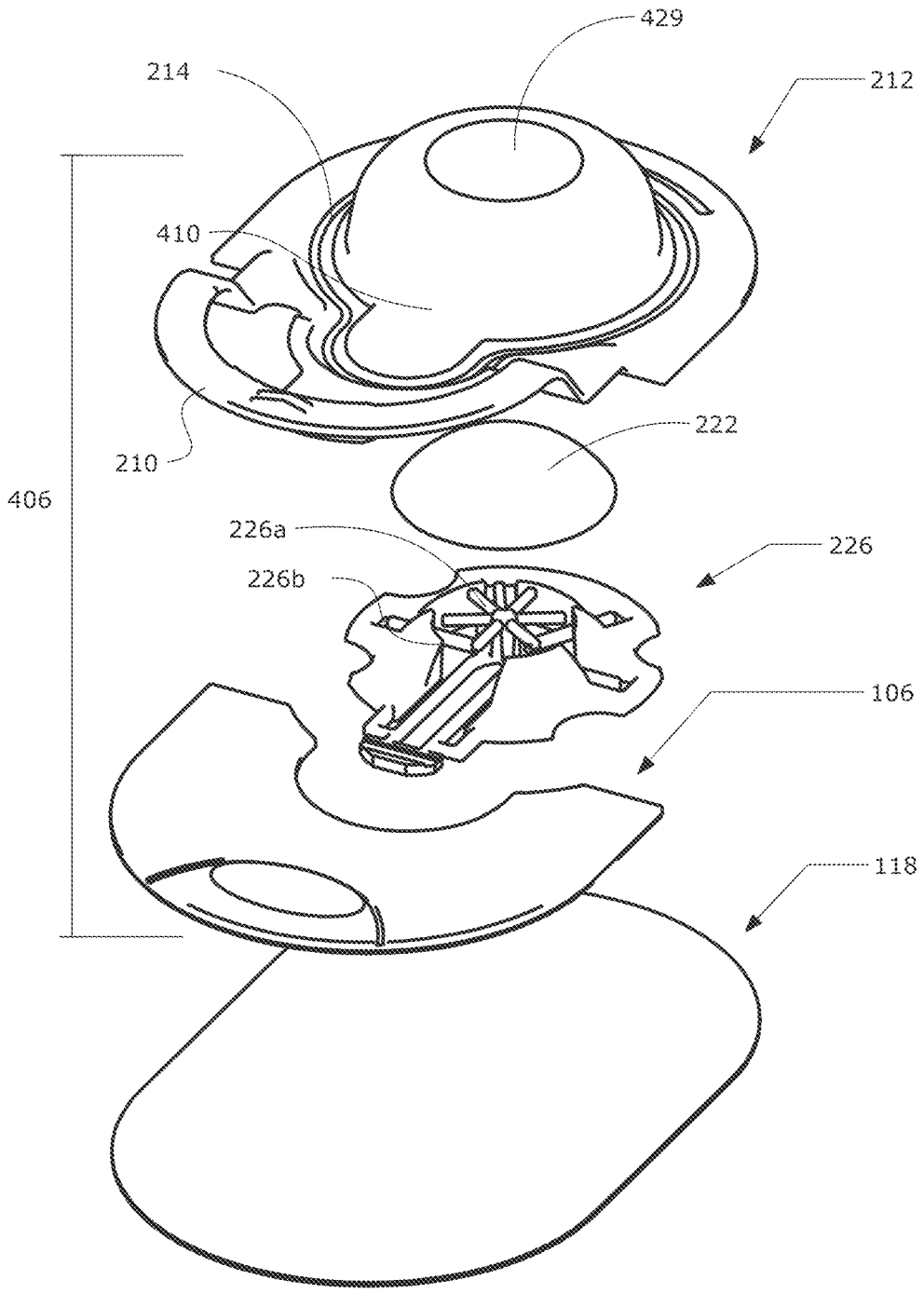
FIG. 4 illustrates an exploded isometric view of a contact lens package according to an alternative exemplary embodiment.

By way of another example, FIG. 4 illustrates an exploded isometric view of a contact lens package 200 and the exemplary embodiments' constituent components: lid 212, lens support 226, grasping member 206, and base 218. Base 218 is composed of a laminated foil sheet. Upper portion 406 of the package 200 includes lens support 226, the lid 212, and the grasping member 206, which are formed of molded plastic are attached to the base 118 via heat seals (or alternative attachment means, such as adhesive, ultrasonic welds, or the like). The lid 212 is releasably attached to the package base via a retortable seal 214 around a lid cavity that houses the contact lens 222, lens support 226, and packaging solution. The lid 218 includes opening tab 210 in the form of an arcuate raised handle. Lid 218 further includes an air entry scoop 410 located along a point in the seal 114 that first break with the opening tab 110 is engaged by the wearer. The lid 212 includes a dimple 429 positioned in the lid 212 above the center of the lens support 226. Lens support 226 has a split arrangement with a primary support member 226*a* centrally located beneath the lens when the package is unopened and a secondary support member 226*b* surrounding the primary support member 226*a* beneath a peripheral edge of contact lens 222 to provide support to the peripheral concave side of the lens 222 when the package is unopened.

Figure 5A:
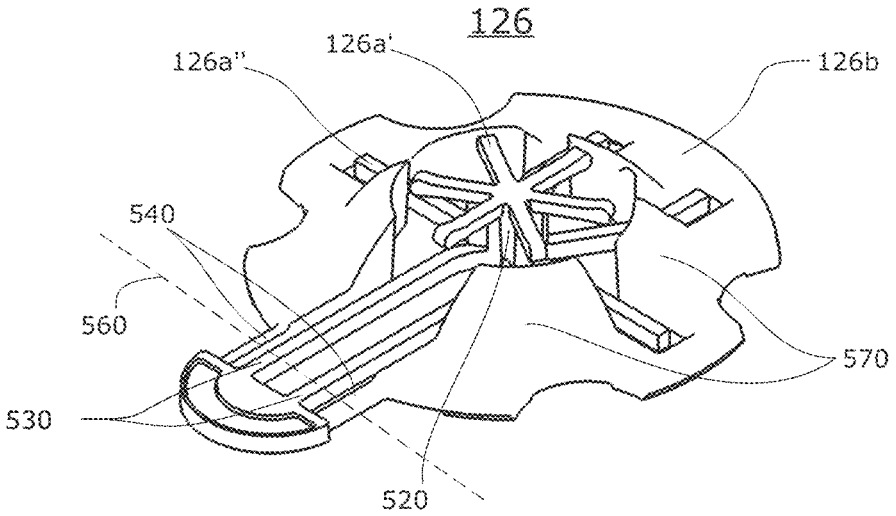
FIGS. 5A and 5B illustrate a lens support of an exemplary embodiment in isometric and top view, respectively.
Figure 5B:
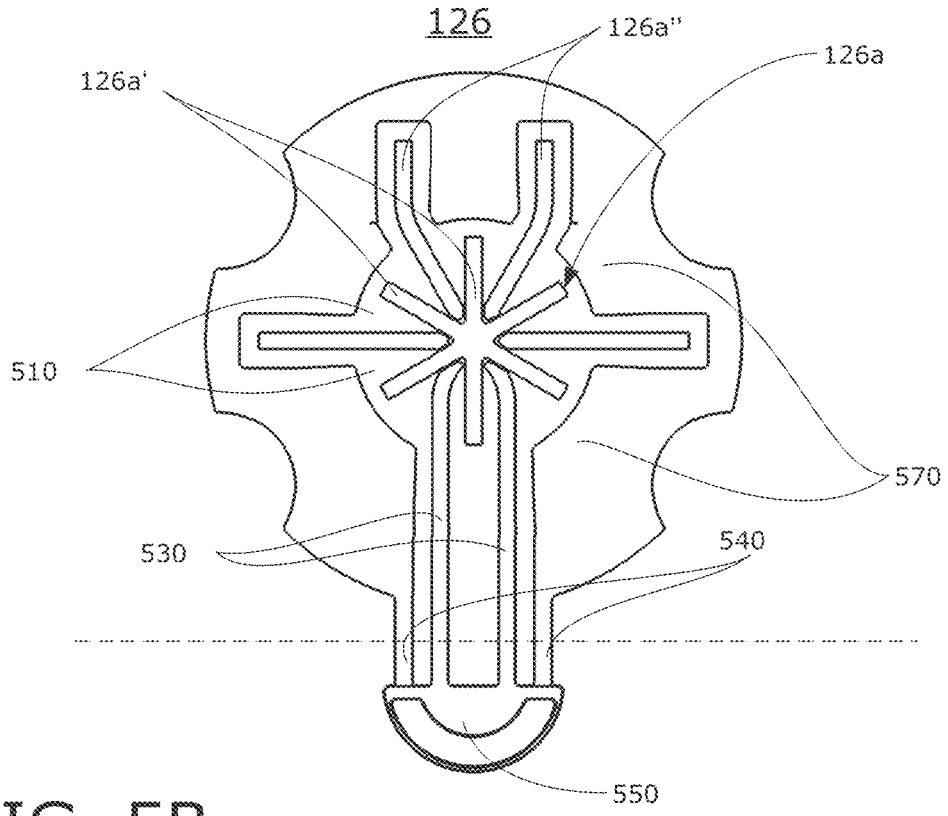

FIGS. 5A and 5B illustrate a lens support of an exemplary embodiment in isometric and top view, respectively. The lens support 126 maintains the lens in the preferred convex orientation (bowl down relative to the base of the package) and position (centered over the support) during shipping and storage. The lens support 126 also provides open space 510 to allow, upon opening, the packaging solution to drain from the lens and support 126 without trapping water between the support; and a sufficient number of contact points with the lens to reduce the incidence of the lens from collapsing onto, rotating off or translating across the support. This allows the apex of the lens to be supported by the lens's own elastic stiffness, or to minimize sinking of the lens apex while limiting the contact area between the support 126 and lens. Too much contact between the support 126 and the lens after solution draining, and water trapped between the support and the lens, can create surface tension between the lens and water on and around the lens support that is greater than the surface tension between a wearer's finger and the lens, interfering with efficient lens transfer.

For lenses made from polymers with longer shape memory, a lens support may be designed to limit contact between the lens and support during storage. Such contact may be distributed around the lens peripheral edge. Contact between the lens optic zone, lens support and lid interior (including any air entry guides) may be transitory or there may be no contact between the optic zone and support, lid, or air entry guides. Lenses, such as conventional hydrogels, having shorter shape memory, are less prone to distortion from packaging contact, and can have the contact points distributed around the periphery and throughout the lens profile, including the lens center zone (about 9 mm, or about 5 mm diameter).

The lens supports of the present invention preferably allow, upon dabbing, both the fingertip and lens to deform to match each other's shape, without causing lens inversion or damage to lens during removal from too much pressure during dabbing. Thus, an aspect of the removal of the lens from the present packages is to control the ratio of the contact area between the finger and lens as compared to the area between the lens and the lens support so that the contact area between the finger and lens exceeds the contact surface area of the lens support on the lens underside. This will ensure that surface tension between finger and lens exceeds surface tension between lens and lens support. Thus, the lens will adhere to the finger for lens transfer and placement onto the eye.

The lens support 126 is illustrated in the configuration associated with the package being in an unopened state. In this embodiment, lens support 126 has a split arrangement with one support member 126*a*, also referred to herein as primary support member, in an inner position and another support member 126*b*, also referred to herein as a secondary support member, surrounding the primary member 126*a* to form a nested configuration. Primary support member 126*a* is positioned beneath at least a portion of the concave side of a contact lens at a region outside of the optical zone of the lens peripheral edge of contact lens 122 to provide support to the peripheral concave side of the lens 122 when the package is unopened. "Support(ing)" the contact lens as used herein to describe a lens support's functionality when the package is unopened is not meant to require intimate contact with the lens. To the contrary, packages of the invention preferably minimize contact with the contact lens when the package is closed and the lens is suspended in packaging solution. Ideally, the optical zone of the lens is free floating and contact with the lens support during storage is transitory or non-existent. However, the forces of gravity and air bubbles in the packaging solution may produce undesirable interactions between the lens and the packaging. If not counteracted, these interactions may result in significant optical damage. Therefore, the inventors have recognized that a lens support ideally should provide support to the lens in solution when the lens is "loaded," i.e., forced against the interior of the package by gravity and/or air bubbles. In the fashion described with reference to the exemplary opening method in FIG. 2C, primary support member 126*a* is configured so that when the package is in an opened state, the contact lens rests on the primary support member support 126*a*, and the secondary support member 126*b* is moved away from the lens in concert with packaging solution draining away the lens, thereby leaving the lens, preferably but optionally, sufficiently unwetted upon the central support member to permit single-touch transfer by the wearer.

Primary support member 126*a* in this embodiment includes a central support portion having a plurality of central support arms 126*a*' and peripheral support arms 126*a*" upon which the lens centers and ultimately lens rests when the package is opened. The central support arms 126*a*' are elevated relative to the peripheral support arms 126*a*" and secondary support member 126*b* via a column 520. Upon opening, the contact lens periphery will rest on the peripheral supports 126*a*" and the lens may additionally rest on the central support supports 126*a*". The design of primary support member 126*a* represents one of myriad examples of a support profiles that does not substantially match the lens profile. In comparison with known lens supports that substantially match the profile of the lens, the mismatched profiles of the primary supports in certain embodiments of the present invention (of which the depicted embodiment presents merely one) facilitate lens transfer by, among other things, reducing the wetted contact area between the primary lens support and the lens is less than about 20 $mm^2$, less than about 20 $mm^2$, less than about 18 $mm^2$ or less than about 15 $mm^2$. Furthermore, primary lens supports preferably comprise a plurality of peripheral supports which have a distal end extending at least 1 mm beyond the contact lens peripheral edge and provide at least 3, 3 to 14, 4 to 14, 3 to 8 or 4 to 8, 4 to 6 or 6 points of contact with the contact lens edge along the peripheral supports and wetted contact between the support and the lens after the package has been opened and the packaging solution has been directed away from the lens and support.

Primary lens support 126*a* and secondary lens support 126*b* are, in this embodiment, a unitary component formed as a single piece of molded plastic. Primary support member 126*a* and secondary support members 126*b* are attached via primary cantilevers 530 and secondary cantilevers 540, respectively, which join at a crosspiece 550. Crosspiece 550 is in turn affixed to the base of the package. While crosspiece 550 serves as the single point of attachment between the primary support member 126*a* and the package base, secondary member 126*b* is additionally fixedly attached by additional via heats seals (not shown) to a portion of the base that pivots away during opening. As a result, the secondary support member 126*b* pivots away with that portion of the base during opening, and consequent drainage of packaging solution away from the lens and primary support member 126*a*, while the primary support member remains relatively fixed in space or lifts at an angle relatively to horizontal as the package hinges open (as described more illustratively above in reference to FIGS. 2C and 2D). The pivoting, also referred to as a hinging action (or articulation in the more general concept), of the base creates a hinge line along which secondary cantilevers 540 bend as its pivots away and across which the primary cantilevers 530 remain relatively straight upon opening.

Primary and secondary cantilever 530 and 540 may provide an additional benefit of aiding the channeling packaging solution along a drainage path from around the lens (as more generally discussed relative to FIGS. 2A-D) in the lens cavity and preferably toward recapture in the lid. More specifically, cantilevers 530 and 540 may function as a drainage channel that creates a temporary film of packaging solution flowing off the lens, along the general drainage path, working with gravity to drain that film away. In this way, the drainage channel helps to minimize pooling of packaging solution between the back of the lens and lens support structures when the package is opened and the lens support is held out of the packaging solution. In certain embodiments, a drainage channel may comprise a gap between two adjacent members, e.g., cantilevers, or a when a single member is used, a split in the single member. For lens supports without peripheral support members, the drainage channel gap may begin at any point inside the lens periphery. For supports with peripheral support members, the drainage channel gap may begin either at the inner edge of the peripheral members or at any point inside the lens periphery.

In another aspect, in this embodiment secondary support member 126*b* has a convex, partial dome profile 570 that partially mirrors the contact lens's profile. The split arrangement, whereby the secondary support member 126*b* moves away from the lens upon opening, make it such that the secondary support member is not in physical contact with the lens when the package is open and the lens is presented for transfer. Accordingly, an excess wetted area that may otherwise exist between the lens and lens support is avoided, while the benefits of a supporting having a profile that mirrors the lens to an extent (i.e., additional support and protection the lens) are maintained by the secondary support 126*b* when the package is unopened such as during storage, shipment, and handling.

Split lens support arrangements, such as the illustrated embodiment herein, may provide multiple benefits, including the secondary support 126*b* filling more volume within the cavity thereby reducing the amount of solution required to hydrate the lens; reducing the incidence of the lenses sticking to the lid during opening by increasing the surface area that makes contact with the lens as air enters the package forces the lens onto the lens support; and reducing lens damage, restricting air bubble movement, and lens inversion. In achieving some or all of these benefits, it is preferable but optional that the lens support, whether singular, or split among secondary and primary and potentially other components, fills the space under the contact lens and under the lens's peripheral edge as much as possible.

It must be emphasized that the lens support embodiment illustrated and described here is one among of myriad embodiments of a lens support within the scope of the invention as set forth in the appended claims. It will be appreciated that other embodiments are possible, including embodiments where, for example, there is a single support instrumentality (e.g., a primary support but no secondary support) or a lens support with primary and secondary support members formed as separate pieces. Furthermore, while the secondary support member 126*b* is formed as the same part as the primary support member 126*a*, in other embodiments the secondary support may be a separately formed, i.e., a discrete part, or and/or may be made integral with the package base. Further still, it is possible to achieve the functionality and benefits of lens supports within the scope of the appended claims in other alternative designs, such as for example where it is the primary support member that surrounds the secondary support member or an arrangement in which the support member that moves away or detaches from the lens upon opening may sit both inside and outside of the primary lens support.

Figure 6:
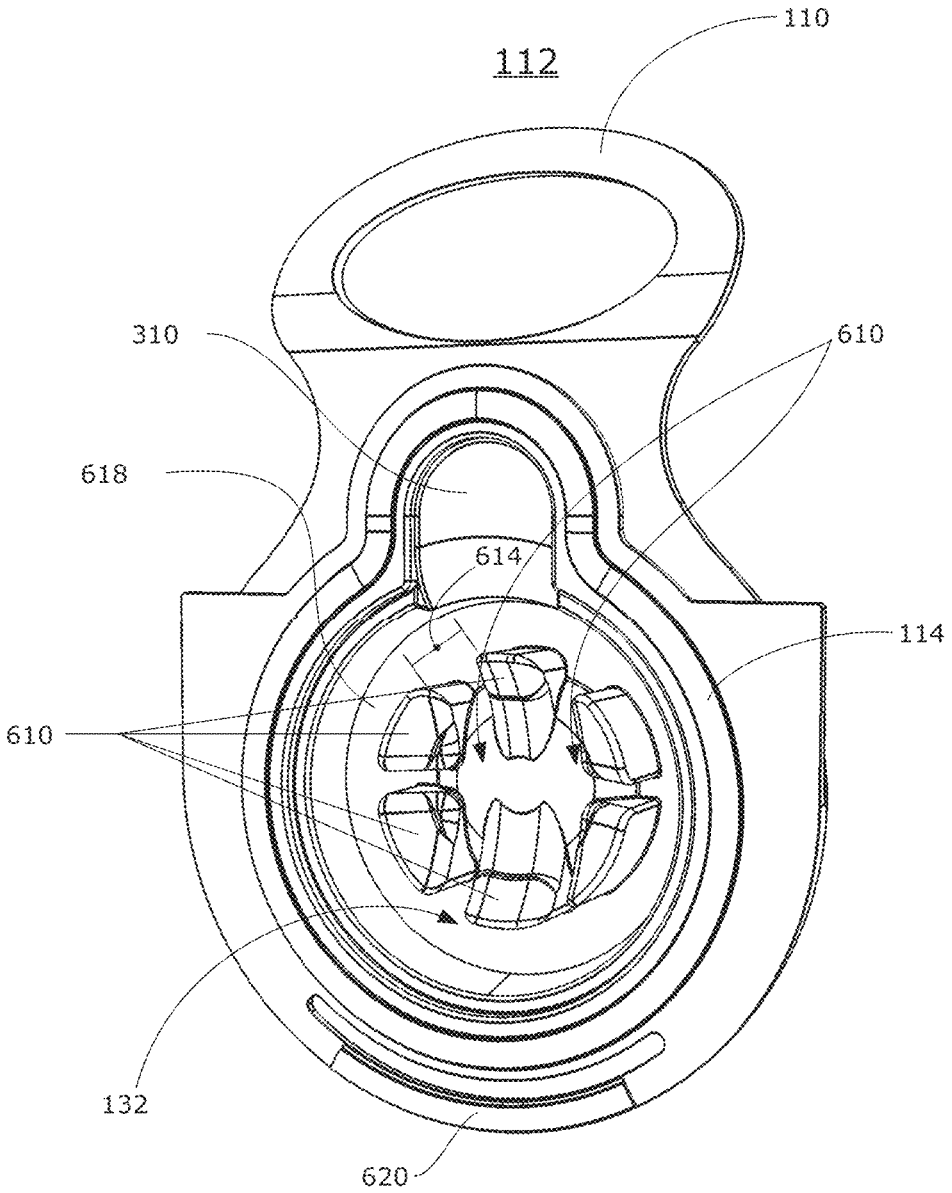
FIG. 6 illustrates is a perspective of view of the underside of a lid and interior of a lid cavity in accordance with an embodiment.

Referring now to FIG. 6, illustrated is a perspective of view of the underside of a lid 112 and interior of a lid cavity 132 in accordance with an embodiment. The lid 112 includes lid cavity 132 configured to be positioned over a contact lens in a convex position within lid cavity 112 when the package is unopened. The lid 112 includes multiple lens facing surfaces 610, which in this embodiment are formed as projections extending downward toward the lens's convex surface. The lens facing surfaces 610 are generally shaped to mirror the convex lens surface of the contact lens to be housed in the lid cavity 132. In this case, the lens facing surfaces 610 serve to i) align the contact lens over the lens support; ii) promote the egress of air to a peripheral volume of the cavity; and iii) protect the contact lens against significant optical damage due to gravitational or air-induced forces. Lens facing surfaces 610 also operate as air entry guides by guiding air entering the lid cavity, as aided by air entry scoop 114, over the contact lens to reduce the incidence of the contact lens sticking to the lid upon opening.

As noted above, the forces of gravity and air bubbles in the packaging solution result in optical damage if not properly counteracted. Lens facing surfaces of the present invention may be designed to support the lens when loaded by these forces to avoid or reduce significant optical damage. In one aspect, lens facing surfaces, as in the lens facing surfaces 610 of the illustrated embodiment, include a relatively large contactable surface area, at least about 3 percent and preferably at least about 20% of percent or as large as possible while still accommodating any desired air egress channels. The contactable surface area is understood to mean the area of contact between the lens and lens facing surfaces when the lens is loaded, i.e., placed into contact under an applied force, such as but not limited to gravity or air bubble interaction. The contactable surface area determines the pressure exerted on regions of the lens when/if it is loaded. The larger the area, the more the pressure is reduced. In the embodiment illustrated, the lens facing surfaces 614 have a contactable surface area of 22% relative to a conventional contact lens having a surface area of approximately 225 $mm^2$.

The lens facing surfaces 610 are also spaced apart to define multiple air egress channels that allow air, in particular air bubbles in the packaging solution, to travel away from the contact lens into a peripheral volume 618 of the lid cavity 132. It is advantageous for the air egress channels have a positive gradient toward the peripheral volume with a vertical rise of at least about 2 mm. In embodiments such as the exemplary embodiment illustrated herein, the minimal headspace above the lens created by the dimple 329 (shown in FIG. 3), in combination with the presence of a peripheral volume 618 generally causes any large air bubbles, e.g., bubbles greater than 2 mm in diameter from situating themselves above the lens. Thus, the air egress channels generally are primarily concerned with permitting smaller air bubbles to escape from the area around the lens surface while simultaneously avoiding larger bubbles to enter the space around the lens from the peripheral volume when the package is in certain orientations. Toward this end, preferred embodiments include at least two air egress channels each having a width of between about 1 mm-1.5 mm or preferably between 1.5 mm-2 mm. In a related aspect, air egress channels 614 are advantageously positioned relative to each other such that, when the package is rotated in a side orientation, at least one of the channels 614 will have a central axis from near the center of the cavity that is angled relative a plane normal to gravity. This design aspect exploits buoyancy to allow air bubbles to escape away from lens irrespective of the orientation the lens package take thus reducing the optical damage that might otherwise result, e.g., from the air bubble forcing the lens into the lens support. Channels 614 in this embodiment are also positioned and sized to permit peripheral spoke members 126*a*" (shown in FIG. 5B) to permit an uninterrupted path between lid and spokes when the package is being opened.

Referring still to FIG. 6, a terminating means in the form of attachment surface 620 may also be noted at the distal end of lid 112. This heat seal 620 functions as an additional seal to the retortable seal 114 on the surface around the perimeter of the lid cavity 132. In this way, when the restorable seal 114 has broken beginning adjacent to the air entry scoop 114 and moving distally as open tab 110 is engaged, the lid 110 is less prone to fully separate from the base. After opening, and preferably after recapture of packing solution in the lid, heat seal 620 in turn may hold the lid cavity in relatively a horizontal orientation, which facilitates keeping the solution from in the lid cavity 132 from spilling out of the package.

Lens facing surfaces 610 are generally shaped to mirror the convex lens surface of the contact lens to be housed in the lid cavity 132 and are sloped from their periphery toward a nadir of the dimple 329 in the interior of lid cavity 132 to create a minimal headspace above the lens apex when the package is sealed and the contact lens is suspended in packaging solution. As a result, significant air bubbles cannot position themselves at or near the apex of the lens (and optical zone), and thus harmful air bubble interaction is minimized.

Figure 7:
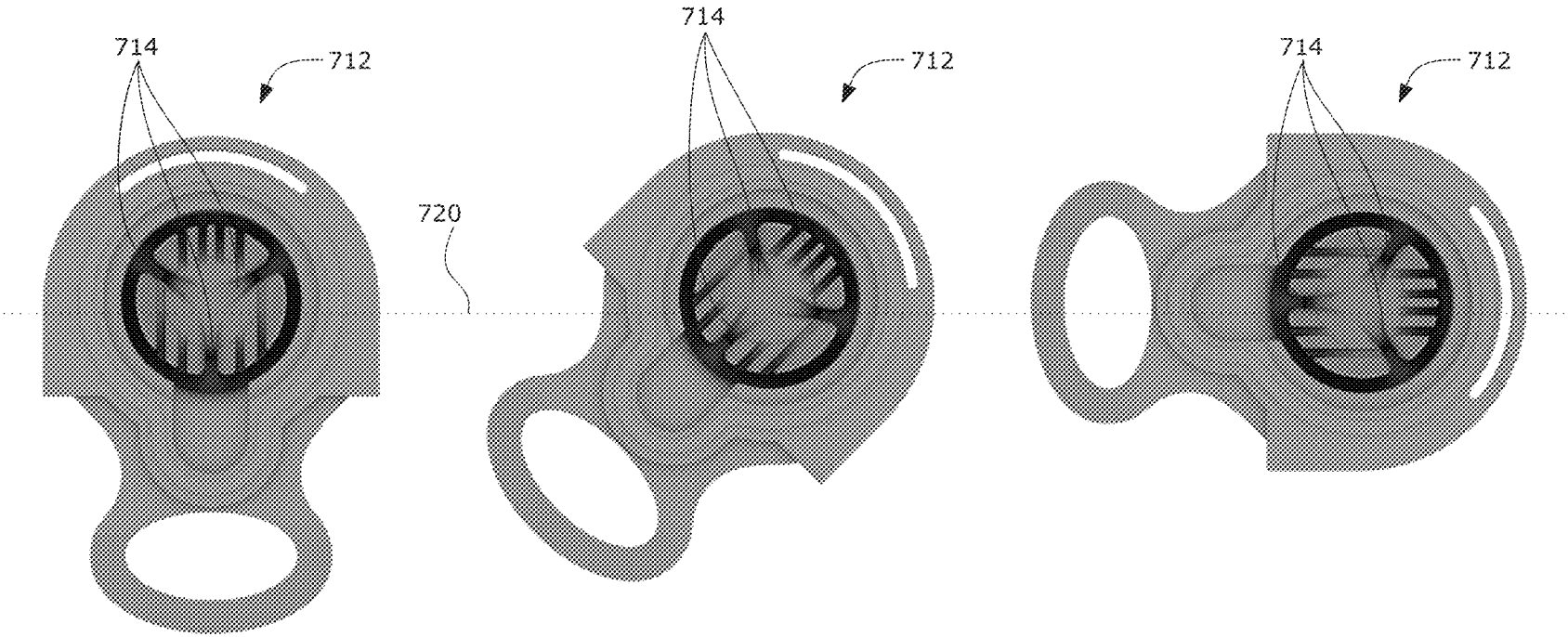
FIG. 7 illustrates an alternative embodiment of lens facing surfaces of a lid in various orientations.

Referring now to FIG. 7, an alternative embodiment of lens facing surfaces of a lid 712 in various orientations is illustrated. Air egress channels 714 are advantageously positioned relative to each other such that, when the package is rotated in a side orientation, at least one of the channels 614 will have a central axis from the center of the cavity that is angled relative a plane 720 normal to gravity. As noted above, this design aspect exploits buoyancy to allow air bubbles to escape away from lens irrespective of the orientation the lens package take thus reducing the optical damage that might otherwise result, e.g., from the air bubble forcing the lens into the lens support. It will be appreciated, again, that lids, as well as other components specifically described and illustrated herein, may be mixed and combined to form myriad permutations and, for example, various lens supports (including unitary as opposed to split supports) may be employed.

Figure 8:
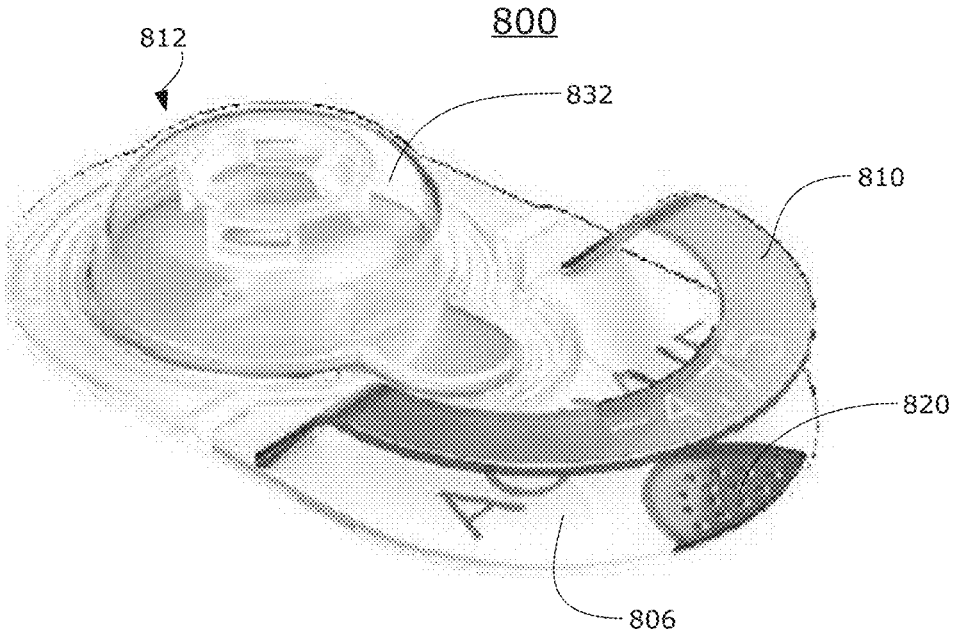
FIGS. 8 and 9 illustrate exemplary embodiments of contact lens packages that include a colored region.
Figure 9:
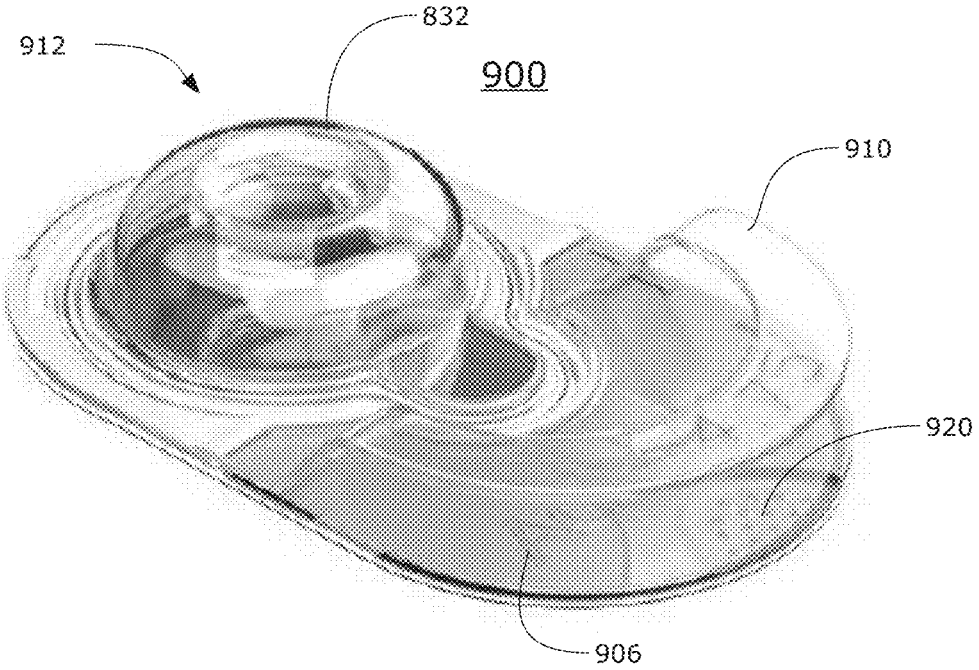

FIGS. 8 and 9 illustrate exemplary embodiments of contact lens packages that include a colored region and/or tactile feature. In FIG. 8, contact lens package 800 includes a grasping member 806 and an opening tab 810. In this embodiment, lid 812 includes an opening tab 810 takes the form of a handle. The lid is composed of a unitary molded plastic part formed by a two-shot injection molding process with the lid cavity 832, seal, and surrounding regions, other than opening tab 810 are substantially clear, and the opening tab 810 is colored (e.g., blue, green, red, or any other color, preferably a pantone color capable of being readily distinguished by the wearer) in order to distinguish the opening tab 810 from the rest of the lid and, in this embodiment also the grasping portion. The color may be opaque or semi- or fully translucent, as desired. In this way, the colored handle serves as a visual indication to the wearer of the correct package orientation for opening and that the package is to be opened by engaging the opening tab.

Two-shot injection molding is known in the art and is often referred to as 2 k molding or double injection. The process allows a single injection molded part to be formed using two different but compatible injection-molded materials or the same material having different colors. In this embodiment, a polypropylene plastic is utilized, however other materials, including any substantially rigid plastic suitable for injection molding small parts such as polypropylene homopolymers may be used. The two-shot molding apparatus may be programmed to perform two injections in one cycle. In a first cycle, a nozzle injects plastic into a mold. The mold is then automatically rotated, and a second plastic is injected into the mold from a second nozzle. The molding apparatus copolymerizes the two plastics to form a molecular bond between the two, resulting in a unitary part.

Grasping member 806 of lens package 800 further includes a tactile feature 820 in the form of a region of dimples which may serve multiple functions, including indicating to the wearer by tactical feedback that their hand is correctly placed for opening the package and/or producing a more slip-resistant grasp between a wearer's hand and the package. The tactile feature 820 is colored whereas the rest of the grasping member 806 is substantially clear, thereby visually distinguishing the tactile feature 820. The grasping feature may be formed by the aforementioned two-shot injection process. Any form or placement and shape or factor for the tactile features are possible. For example, in some embodiments the tactile feature may be raised instead of depressed and may be any shape, logo or other branding, or may be raised or recessed wording or numbering. Opening tab (handle) 810 is also provided with printed product information, especially prescription information for the contact lens housed inside the package. Printing may be performed by any means suitable for plastic parts, including digital ink jet printing, screen printing, flexo printing, pad printing, laser printing or the like.

The contact lens package 900 embodied as illustrated in FIG. 9 includes a grasping member 906 and an opening tab 910. In this embodiment, lid 912 includes an opening tab 910, which takes the form of a handle. The lid 912 and integral handle 910 are composed of a unitary and substantially clear molded plastic part. Grasping member 906 has a color to distinguish the grasping member 906 from the lid and the rest of lens package 800. Grasping member 906 further includes a tactile feature 820 in the form of a region of dimples which may serve multiple functions, including indicating by tactical feedback to the wearer that their hand is correctly placed of at least a portion of a hand for opening the package and/or producing a more slip-resistant grasp between a wearer's hand and the package. In this embodiment, the tactile feature 902 has the same color as the rest of the grasping portion. Grasping portion 906 includes branding 930, which may be formed by molding, embossing, or the like and which may provide further tactile feedback. Opening tab (handle) 901 is also provided with printed product information, for example prescription information for the contact lens housed inside the package. Myriad combinations of colored and tactile features are possible within the scope of the claims.

The visual and tactile cues as disclosed herein may be especially important for novel contact lens packages of the present invention, which departs significantly in form and method of opening from conventional contact lens packages. In a conventional package, the contact lens sits in a molded plastic base, having a bowl to receive the contact lens in a concave, bowl up position. Aspects of certain embodiments of the present invention described and illustrated by the figures herein turn these conventions on their head in one or a combination of ways, for example, by presenting the lens in a convex orientation; by the placing the lens cavity at the top of the package instead of the bottom; opening the substantially rigid side instead of the flat foil; and/or recapturing packaging solution in the lid. The addition of visual or tactile features may create a more intuitive opening experience for the wearer.

The foregoing description, for purposes of explanation, used specific nomenclature to provide a thorough understanding of the described embodiments. However, it will be apparent to one skilled in the art that many of the specific details are not required in order to practice the described embodiments. Thus, the foregoing descriptions of the specific embodiments described herein are presented for the purposes of illustration and description. They are not targeted to be exhaustive or to limit the embodiments to the precise forms disclosed. It will be apparent to one of ordinary skill in the art that many modifications and variations are possible in view of the above teachings.

The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The packages of the present invention may be manufactured using known materials and processes. The packaging materials may be virgin, recycled or a combination thereof. The volume within the package cavity can vary depending on the design selected.

Not all the features described herein need to be incorporated into every package, and those of skill in the art, using the teachings herein, can combine the features to provide a wide variety of improved contact lens packages. In summary, the contact lens packages of the present invention incorporate several novel functionalities which may be combined in a wide variety of combinations as described herein to provide the desired improved and/or single touch packaging. The breadth and scope of the present invention should not be limited by any of the above-described exemplary embodiments but should be defined only in accordance with the following claims and their equivalents.

What is claimed is:

1. A contact lens package comprising:

a contact lens; and a lens support comprising a first support member and a second support member configured to support a concave side of the contact lens housed in a cavity when the package is in an unopened state;

wherein the second support member is configured such that, when the package is in the unopened state, a peripheral edge of the contact lens rests on at least a portion of the second support member;

wherein the package is configured such that, when the package is in an opened state, the contact lens rests on at least a portion of the first support member and the second support member is moved away from the lens.

2. The contact lens package of claim 1, wherein the second support member pivots away from first support member during opening.

3. The contact lens package of claim 1, wherein the first and second support members are a unitary component.

4. The contact lens package of claim 1, wherein the second support member is fixedly attached to at least a portion of a base of the package.

5. The contact lens package of claim 1, wherein the first and second support members have a nested configuration when the package is in an unopened state.

6. The contact lens package of claim 1, wherein the first support member has a first profile that does not substantially match the contact lens's profile.

7. The contact lens package of claim 1, wherein the second support member is integral to a base of the package.

8. The contact lens package of claim 1, further comprising a drainage path defined along a length of the lens support.

9. The contact lens package of claim 8, further comprising a hinge defined between a lid and a grasping member and transverse to the drainage path, wherein upon opening the package bends along the hinge and the packaging solution drains away from the contact lens along the drainage path.

10. The contact lens package of claim 1, wherein, when the package is in an opened state, the wetted contact area between the first support member and the contact lens is less than about 25 $mm^2$, less than about 20 $mm^2$, less than about 18 $mm^2$ or less than about 15 $mm^2$.

* * * * *